US012428809B2

(12) United States Patent
Nishi

(10) Patent No.: US 12,428,809 B2
(45) Date of Patent: Sep. 30, 2025

(54) SHOVEL, CONTROLLER FOR SHOVEL, AND METHOD OF MANAGING WORKSITE

(71) Applicant: SUMITOMO CONSTRUCTION MACHINERY CO., LTD., Tokyo (JP)

(72) Inventor: Takashi Nishi, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 591 days.

(21) Appl. No.: 17/323,037

(22) Filed: May 18, 2021

(65) Prior Publication Data

US 2021/0270013 A1 Sep. 2, 2021

Related U.S. Application Data

(63) Continuation of application No. PCT/JP2019/045204, filed on Nov. 19, 2019.

(30) Foreign Application Priority Data

Nov. 19, 2018 (JP) ..... 2018-216733

(51) Int. Cl.
*E02F 9/20* (2006.01)
*E02F 3/32* (2006.01)
*E02F 3/43* (2006.01)

(52) U.S. Cl.
CPC ..... *E02F 9/2004* (2013.01); *E02F 3/32* (2013.01); *E02F 3/435* (2013.01)

(58) Field of Classification Search
CPC . E02F 9/2004; E02F 3/32; E02F 3/435; E02F 3/434; E02F 3/962; E02F 9/205; E02F 9/261; E02F 9/264; E02F 9/24; E02F 9/26; G08B 21/24; H04N 7/18
USPC ..... 701/50, 301; 340/438, 469, 456, 461, 340/982, 985
See application file for complete search history.

(56) References Cited

U.S. PATENT DOCUMENTS

| | | | | |
|---|---|---|---|---|
| 8,028,787 | B2 | 10/2011 | Akahane et al. | |
| 8,768,581 | B2 | 7/2014 | Mizuochi et al. | |
| 9,841,768 | B2 | 12/2017 | Hiramatsu et al. | |
| 2013/0271274 | A1* | 10/2013 | Ebert | E02F 9/2054 |
| 2014/0121840 | A1* | 5/2014 | Mizuochi | G06F 30/15 |
| 2014/0309918 | A1* | 10/2014 | Rivet | F16P 3/147 |
| 2015/0142276 | A1 | 5/2015 | Wu et al. | |

(Continued)

FOREIGN PATENT DOCUMENTS

| | | | | |
|---|---|---|---|---|
| CA | 2781349 | A1 * | 12/2012 | B66C 15/04 |
| CN | 101522377 | A * | 9/2009 | B25J 9/1676 |

(Continued)

OTHER PUBLICATIONS

Machine Translation of CN-101522377-A, "Manipulator" (Year: 2009).*

(Continued)

*Primary Examiner* — Ramon A. Mercado
*Assistant Examiner* — Ellis B. Ramirez
(74) *Attorney, Agent, or Firm* — IPUSA, PLLC

(57) ABSTRACT

A shovel includes processing circuitry configured to predict the motion of the shovel and, in response to predicting that the shovel next performs a predetermined motion, issue an alert indicating that the predetermined motion is to be performed to an area surrounding the shovel before the start of the predetermined motion.

20 Claims, 9 Drawing Sheets

(56) References Cited

U.S. PATENT DOCUMENTS

| | | | | |
|---|---|---|---|---|
| 2016/0247332 | A1 | 8/2016 | Egawa | |
| 2017/0183845 | A1* | 6/2017 | Izumikawa | E02F 3/32 |
| 2017/0191246 | A1* | 7/2017 | Friend | E02F 3/434 |
| 2019/0161943 | A1* | 5/2019 | Frank | E02F 9/24 |
| 2019/0218749 | A1* | 7/2019 | Hiromatsu | E02F 9/2045 |
| 2020/0277757 | A1* | 9/2020 | Kurokami | E02F 9/24 |
| 2021/0174660 | A1* | 6/2021 | Kamimura | E02F 9/26 |

FOREIGN PATENT DOCUMENTS

| | | | |
|---|---|---|---|
| EP | 2472011 | | 7/2012 |
| JP | 855-142350 | U | 10/1980 |
| JP | H04-90444 | U | 8/1992 |
| JP | H11-252711 | | 9/1999 |
| JP | 2002-201676 | | 7/2002 |
| JP | 2007-162279 | | 6/2007 |
| JP | 2013-238097 | | 11/2013 |
| JP | 2014-214566 | | 11/2014 |
| JP | 2015-188423 | | 11/2015 |
| JP | 2018-172943 | | 11/2018 |
| WO | 2011/148946 | | 12/2011 |
| WO | 2018203089 | | 11/2018 |

OTHER PUBLICATIONS

International Search Report for PCT/JP2019/045204 mailed on Feb. 10, 2020.

* cited by examiner

SHOVEL, CONTROLLER FOR SHOVEL, AND METHOD OF MANAGING WORKSITE

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2019/045204, filed on Nov. 19, 2019 and designating the U.S., which claims priority to Japanese patent application No. 2018-216733, filed on Nov. 19, 2018. The entire contents of the foregoing applications are incorporated herein by reference.

BACKGROUND

Technical Field

The present invention relates to shovels, controllers for shovels, and methods of managing a worksite.

Description of Related Art

For example, a shovel that encourages its operator to understand the situation of the shovel by predicting its motion and making it known to the operator is known.

A shovel that predicts the tipping of a shovel and makes it known to its operator is known.

SUMMARY

According to an aspect of the present invention, a shovel includes processing circuitry configured to predict the motion of the shovel and, in response to predicting that the shovel next performs a predetermined motion, issue an alert indicating that the predetermined motion is to be performed to an area surrounding the shovel before the start of the predetermined motion.

DETAILED DESCRIPTION

Workers, etc., around a shovel, who need to act with the advance knowledge of the motion of the shovel during its traveling or swinging, may have difficulty in acting while being constantly aware of its motion because the shovel may be used in various environments. Therefore, it is also necessary to encourage workers, etc., around the shovel to be aware of the motion of the shovel.

Therefore, a technique that makes it possible to encourage workers, etc., around a shovel to be aware of the motion of the shovel is desired.

According to an aspect of the present invention, it is possible to provide a technique that makes it possible to encourage workers, etc., around a shovel to be aware of the motion of the shovel caused by its operator's operation.

An embodiment of the invention is described below with reference to the drawings.

[Shovel Overview]

Figure 1:
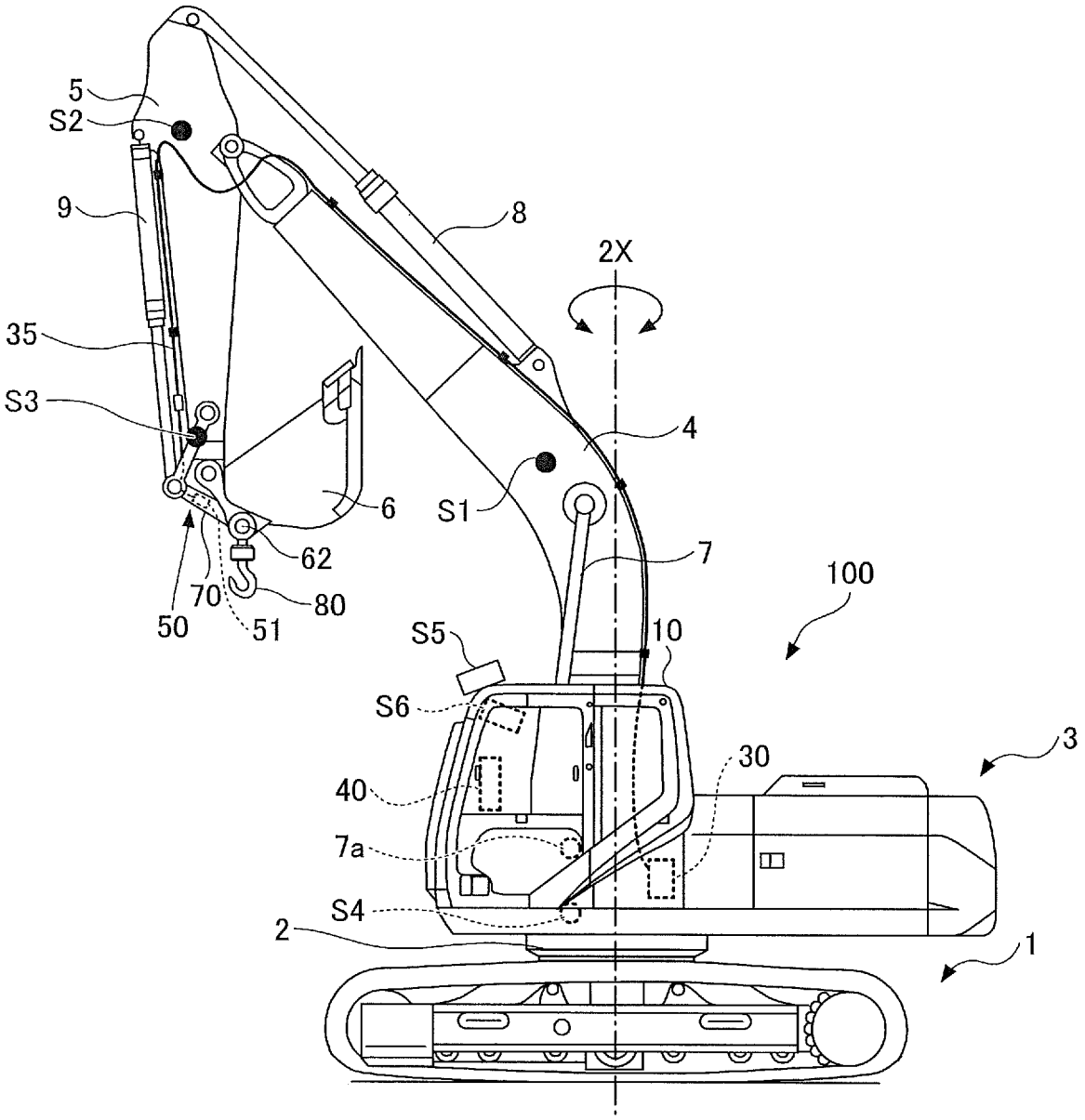
FIG. 1 is a side view of a shovel.

An overview of a shovel 100 according to this embodiment is given with reference to FIG. 1.

FIG. 1 is a side view of the shovel 100 according to this embodiment.

The shovel 100 according to this embodiment includes a lower traveling structure 1; an upper swing structure 3 swingably mounted on the lower traveling structure 1 via a swing mechanism 2; a boom 4, an arm 5, and a bucket 6 serving as an attachment (working device); and a cabin 10.

The lower traveling structure 1 includes, for example, a pair of left and right crawlers, which are hydraulically driven by travel hydraulic motors 1L and 1R (see FIG. 2), respectively, to cause the shovel 100 to travel.

The upper swing structure 3 is driven by a swing hydraulic motor 2A (see FIG. 2) to swing about a swing axis 2X relative to the lower traveling structure 1.

The boom 4 is pivotally attached to the front center of the upper swing structure 3 to be able to rise and lower. The arm 5 is pivotally attached to the distal end of the boom 4 to be vertically pivotable. The bucket 6 is pivotally attached to the distal end of the arm 5 to be vertically pivotable. The boom 4, the arm 5, and the bucket 6 are hydraulically driven by a boom cylinder 7, an arm cylinder 8, and a bucket cylinder 9, respectively, which serve as hydraulic actuators.

Furthermore, a hook 80 for crane work is attached to the bucket 6 serving as an end attachment. The proximal end of the hook 80 is pivotably connected to a bucket pin 62 that connects the arm 5 and the bucket 6. This allows the hook 80 to be stored in a hook storage part 50 formed between two bucket links 70 when work other than crane work, such as excavation work, is performed.

The cabin 10 is a cab in which an operator rides, and is mounted on the front left of the upper swing structure 3.

The shovel 100 operates actuators (for example, hydraulic actuators) according to operations performed by the operator riding in the cabin 10 to drive moving elements (driven elements) such as the lower traveling structure 1, the upper swing structure 3, the boom 4, the arm 5, and the bucket 6.

Furthermore, in place of or in addition to being configured to be operable by the operator in the cabin 10, the shovel 100 may also be configured to be remotely controllable by an operator of a predetermined external apparatus. Examples of the predetermined external apparatus include an assist device 200 and a management apparatus 300 described below. In this case, the shovel 100, for example, transmits image information (captured images) output by a below-described front camera S5 to the external apparatus. Furthermore, various information images (for example, various setting screens) displayed on a below-described display 40 of the shovel 100 as well may likewise be displayed on a display provided on the external apparatus. This allows the operator to, for example, remotely control the shovel 100 while seeing contents displayed on the display provided on the external apparatus. The shovel 100 may operate actuators according to a remote control signal representing the contents of remote control received from the external apparatus to drive moving elements such as the lower traveling structure 1, the upper swing structure 3, the boom 4, the arm 5, and the bucket 6. When the shovel 100 is remotely controlled, there may be no one in the cabin 10. The following description is given based on the assumption that the operator's operation includes at least one of an operation on an operating device 26 performed by the operator in the cabin 10 and remote control performed by the operator of the external apparatus.

Furthermore, the shovel 100 may automatically operate hydraulic actuators, independent of the contents of the operator's operation. With this, the shovel 100 implements the function of automatically moving at least one or more of moving elements such as the lower traveling structure 1, the upper swing structure 3, the boom 4, the arm 5, and the bucket 6 (hereinafter, "automatic operation function" or "machine control function").

The automatic operation function may include the function of automatically operating a moving element (hydraulic actuator) other than an operated moving element (hydraulic actuator) in response to the operator's operation on the operating device 26 or remote control (so-called "semi-automatic operation function"). Furthermore, the automatic operation function may also include the function of automatically operating at least one or more of moving elements (hydraulic actuators) without the operator's operation on the operating device 26 or remote control (so-called "fully automatic operation function"). When the fully automatic operation function is enabled in the shovel 100, there may be no one in the cabin 10. Furthermore, the automatic operation function may include the function of the shovel 100 recognizing the gesture of a person such as a worker around the shovel 100 and automatically operating one or more of moving elements (hydraulic actuators) according to the contents of the recognized gesture ("gesture operation function"). Furthermore, the semi-automatic operation function, the fully automatic operation function, and the gesture operation function may include a mode in which the operation details of a moving element (hydraulic actuator) to be automatically operated are automatically determined according to predetermined rules. Furthermore, the semi-automatic operation function, the fully automatic operation function, and the gesture operation function may include a mode in which the shovel 100 autonomously performs various determinations and the operation details of a moving element (hydraulic actuator) to be automatically operated are autonomously determined along the determination results (so-called "autonomous operation function").

[Shovel Configuration]

Next, a specific configuration of the shovel 100 is described with reference to FIG. 2 as well as FIG. 1.

Figure 2:
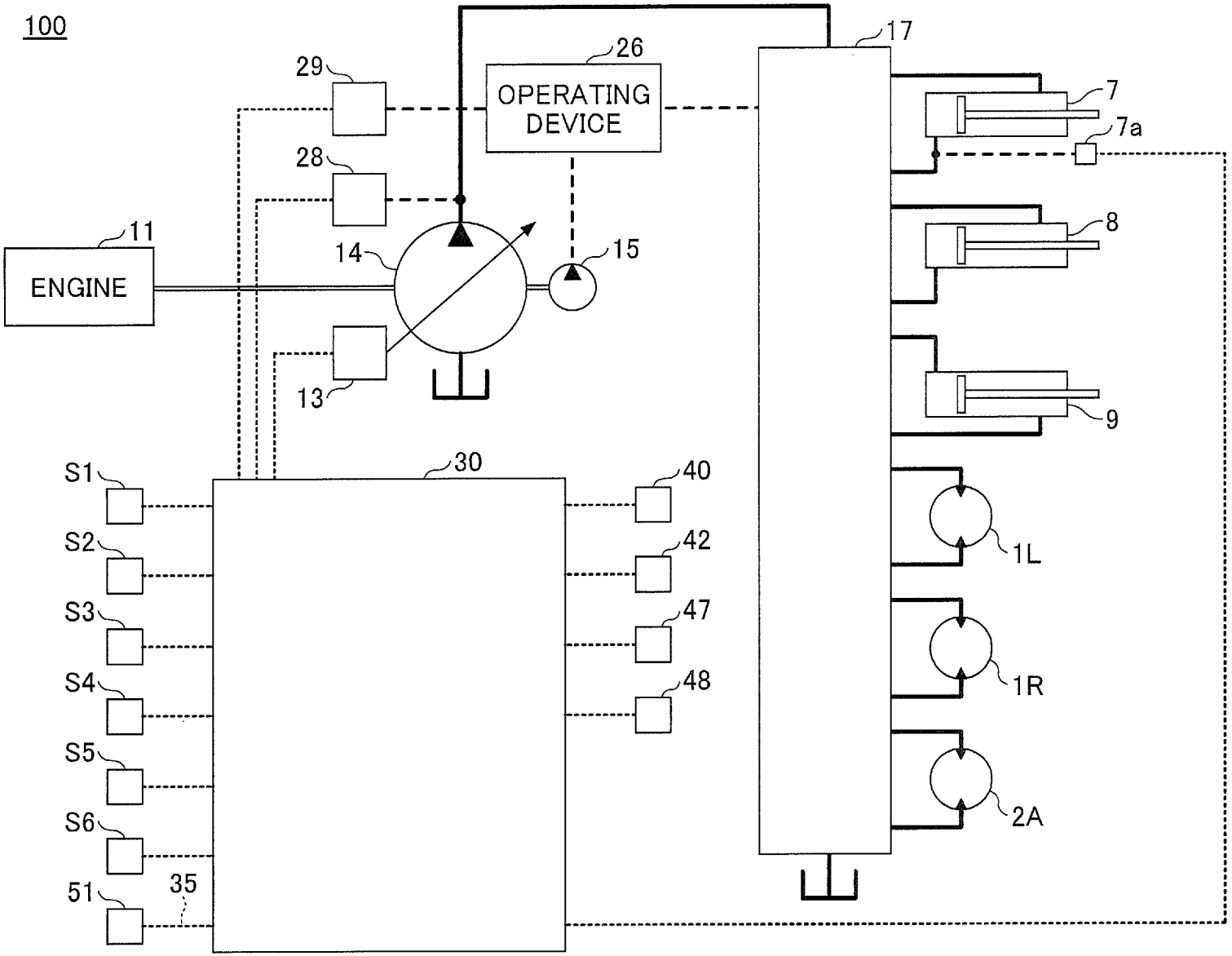
FIG. 2 is a block diagram illustrating an example configuration of the shovel.

FIG. 2 is a block diagram illustrating an example configuration of the shovel 100 according to this embodiment.

In the drawings, a mechanical power line, a high-pressure hydraulic line, a pilot line, and an electric drive and control line are indicated by a double line, a solid line, a dashed line, and a dotted line, respectively. The same applies to FIGS. 3 and 6 below.

A hydraulic drive system of the shovel 100 according to this embodiment that hydraulically drives hydraulic actuators includes an engine 11, a regulator 13, a main pump 14, and a control valve 17. Furthermore, the hydraulic drive system of the shovel 100 according to this embodiment includes hydraulic actuators such as the travel hydraulic motors 1L and 1R, the swing hydraulic motor 2A, the boom cylinder 7, the arm cylinder 8, and the bucket cylinder 9 that hydraulically drive the lower traveling structure 1, the upper swing structure 3, the boom 4, the arm 5, and the bucket 6, respectively, as described above.

The engine 11 is a main power source in the hydraulic drive system and is mounted on the back of the upper swing structure 3, for example. Specifically, the engine 11 rotates constantly at a preset target rotational speed under the direct or indirect control of a controller 30 as described below to drive the main pump 14 and a pilot pump 15. The engine 11 is, for example, a diesel engine fueled with diesel fuel.

The regulator 13 controls the discharge quantity of the main pump 14. For example, the regulator 13 adjusts the angle (hereinafter "tilt angle") of the swash plate of the main pump 14 in response to a control command from the controller 30.

The main pump 14 is, for example, mounted on the back of the upper swing structure 3 the same as the engine 11, and supplies hydraulic oil to the control valve 17 through a high-pressure hydraulic line. As described above, the main pump 14 is driven by the engine 11. The main pump 14 is, for example, a variable displacement hydraulic pump. As described above, under the control of the controller 30, the tilt angle of the swash plate of the main pump 14 may be adjusted by the regulator 13 to adjust the stroke length of its piston, so that its discharge flow rate (discharge pressure) may be controlled.

The control valve 17 is a hydraulic control device that is mounted in the center of the upper swing structure 3 to control the hydraulic drive system according to the operator's operation on the operating device 26 or remote control, for example. As described above, the control valve 17 is connected to the main pump 14 via a high-pressure hydraulic line to selectively supply hydraulic oil supplied from the main pump 14 to hydraulic actuators (the travel hydraulic motors 1L and 1R, the swing hydraulic motor 2A, the boom cylinder 7, the arm cylinder 8, and the bucket cylinder 9) according to the state of operations on the operating device 26 or remote control. Specifically, the control valve 17 includes multiple control valves that control the flow rate and the direction of flow of hydraulic oil supplied from the main pump 14 to the individual hydraulic actuators.

An operation system of the shovel 100 according to this embodiment includes the pilot pump 15 and the operating device 26.

The pilot pump 15 is, for example, mounted on the back of the upper swing structure 3 and supplies pilot pressures to hydraulic devices such as the operating device 26 via a pilot line. The pilot pump 15 is, for example, a fixed displacement hydraulic pump and is driven by the engine 11 as described above.

The operating device 26 is provided near the operator seat of the cabin 10 and serves as an operation input device with which the operator operates various moving elements (the lower traveling structure 1, the upper swing structure 3, the boom 4, the arm 5, the bucket 6, etc.). In other words, the operating device 26 is an operation input device with which the operator operates hydraulic actuators (namely, the travel hydraulic motors 1L and 1R, the swing hydraulic motor 2A, the boom cylinder 7, the arm cylinder 8, the bucket cylinder 9, etc.) that drive corresponding moving elements.

As illustrated in FIG. 2, the operating device 26 is, for example, a hydraulic pilot type that outputs hydraulic oil having a pilot pressure commensurate with its operation details. The operating device 26 is connected to the control valve 17 through a pilot line on its secondary side. This causes pilot pressures commensurate with the operating states of the lower traveling structure 1, the upper swing structure 3, the boom 4, the arm 5, the bucket 6, etc., at the operating device 26 to be input to the control valve 17. Therefore, the control valve 17 can selectively drive corresponding hydraulic actuators according to the operating states at the operating device 26.

Furthermore, the operating device 26 may be, for example, an electric type that outputs an electrical signal (hereinafter "operation signal") instead of being a hydraulic pilot type that outputs a pilot pressure. In this case, the operation signal from the operating device 26 is input to the controller 30, and the controller 30 controls control valves in the control valve 17 according to the input operation signal, thereby achieving the operations of various hydraulic actuators according to the operation details of the operating device 26. For example, the control valves in the control valve 17 may be electromagnetic solenoid spool valves driven by a command from the controller 30. Furthermore, for example, a hydraulic control valve that operates in response to a control command from the controller 30 (hereinafter "operation control valve") may be placed between the pilot pump 15 and a pilot port of each control valve. In this case, when the operating device 26 of an electric type is manually operated, the controller 30 can operate each control valve in accordance with the operation details of the operating device 26 by controlling the operation control valve to increase or decrease a pilot pressure with a control command corresponding to the amount of operation (for example, the amount of lever operation).

The operating device 26 includes, for example, lever devices with which to operate and move the attachment, namely, the boom 4 (the boom cylinder 7), the arm 5 (the arm cylinder 8), and the bucket 6 (the bucket cylinder 9), and to operate and swing the upper swing structure 3. Furthermore, the operating device 26 includes, for example, pedal devices or lever devices with which to operate the left and the right of the lower traveling structure 1 (the travel hydraulic motors 1L and 1R).

A control system of the shovel 100 according to this embodiment includes the controller 30, a boom bottom pressure sensor 7*a*, a discharge pressure sensor 28, an operating pressure sensor 29, the display 40, an input device 42, a storage device 47, an external sound output device 48, a hook storage status detector 51, a boom pose sensor S1, an arm pose sensor S2, a bucket pose sensor S3, a machine body pose sensor S4, the front camera S5, and an indoor camera S6.

The controller 30 (an example of processing circuitry) is, for example, provided in the cabin 10 to control the driving of the shovel 100. The functions of the controller 30 may be implemented by desired hardware, desired software, or their combination. For example, the controller 30 is constituted mainly of a microcomputer that includes a CPU (Central Processing Unit), a memory (also referred to as "primary storage") such as a RAM (Random Access Memory), a non-volatile secondary storage such as a ROM (Read Only Memory), and various input/output interfaces. The controller 30 implements various functions by, for example, executing various programs installed in the non-volatile secondary storage on the CPU.

For example, the controller 30 performs drive control that sets a target rotational speed based on a work mode or the like preset by a predetermined operation on the input device 42 performed by the operator or the like and rotates the engine 11 constantly.

Furthermore, for example, the controller 30 outputs a control command to the regulator 13 as needed to change the discharge quantity of the main pump 14.

Furthermore, for example, when the operating device 26 is an electric type, the controller 30 achieves the operation of a hydraulic actuator corresponding to the operation details of the operating device 26 by controlling an operation proportional valve as described above.

Furthermore, for example, the controller 30 remotely controls the shovel 100 using the operation proportional valve. Specifically, the controller 30 may output a control command corresponding to the details of remote control specified by a remote control signal received from the external apparatus to the operation proportional valve. The operation proportional valve may output a pilot pressure corresponding to the control command from the controller 30, using hydraulic oil supplied from the pilot pump 15, and cause the pilot pressure to act on a pilot port of a corresponding control valve in the control valve 17. This causes the details of remote control to be reflected in the operation of the control valve 17, so that the movements of various moving elements (driven elements) in line with the details of remote control are achieved by hydraulic actuators.

Furthermore, for example, the controller 30 implements the automatic operation function of the shovel 100 using the operation proportional valve. Specifically, the controller 30 may output a control command corresponding to an operation command related to the automatic operation function to the operation proportional valve. The operation command may be generated by the controller 30 or generated by another control device that performs control related to the automatic operation function. The operation proportional valve may output a pilot pressure corresponding to the control command from the controller 30, using hydraulic oil supplied from the pilot pump 15, and cause the pilot pressure to act on a pilot port of a corresponding control valve in the control valve 17. This causes the details of the operation command related to the automatic operation function to be reflected in the operation of the control valve 17, so that the movements of various moving elements (driven elements) from the automatic operation function are achieved by hydraulic actuators.

Furthermore, for example, the controller 30 performs control related to a surroundings monitoring function. According to the surroundings monitoring function, the entry of an object that is a monitoring target into a predetermined area surrounding the shovel 100 (hereinafter "monitoring area") is monitored based on information obtained by a space recognition device such as the front camera S5. The entry of an object that is a monitoring target into the monitoring area may be determined by the space recognition device or determined outside the space recognition device (for example, by the controller 30). Examples of monitoring target objects may include persons, trucks, trailers, other construction machines, utility poles, suspension loads, pylons, and buildings.

Furthermore, the controller 30 performs control related to an object detection announcing function. According to the object detection announcing function, when it is determined with the surroundings monitoring function that a monitoring target object is present within the monitoring area, the presence of the monitoring target object is announced to the operator in the cabin 10 and the area surrounding the shovel 100. The controller 30 may implement the object detection announcing function through visual and aural methods using the display 40 and the external sound output device 48, for example.

Furthermore, for example, the controller 30 performs control related to a motion restricting function. According to the motion restricting function, for example, when it is determined with the surroundings monitoring function that a monitoring target object is present within the monitoring area, the motion of the shovel 100 is restricted. Hereinafter, a description is given, focusing on the case where a monitoring target object is a person.

For example, when it is determined that a monitoring target object such as a person is present within a predetermined area from the shovel 100 (within the monitoring area) based on information obtained by a space recognition device such as the front camera S5 before an actuator is put into operation, the controller 30 may disable the actuator or limit the actuator to very slow operation even when the operator operates the operating device 26. Specifically, when it is determined that a person is present within the monitoring area, the controller 30 may disable the actuator by setting a gate lock valve to a locking state. When the operating device 26 is an electric type, the actuator may be disabled by disabling a signal from the controller 30 to the operation proportional valve. The same applies to the operating device 26 of another type as well on condition that an operation proportional valve that outputs a pilot pressure corresponding to a control command from the controller 30 and causes the pilot pressure to act on a pilot port of a corresponding control valve in the control valve 17 is used. When it is desired to operate the actuator at very slow speed, it is possible to operate the actuator at very low speed by restricting a control signal from the controller 30 to the operation proportional valve such that the control signal corresponds to a relatively small pilot pressure. Thus, when it is determined that a detected monitoring target object is within the monitoring area, an actuator is not driven or is driven at an operation speed lower than an operating speed corresponding to an operation input to the operating device 26 (at very low speed) even when the operating device 26 is operated. Furthermore, when it is determined that a monitoring target object such as a person is present within the monitoring area during the operator's operation of the operating device 26, the operation of an actuator may be stopped or decelerated irrespective of the operator's operation. Specifically, when it is determined that a person is present within the monitoring area, the actuator may be disabled by setting a gate lock valve to a locking state. When an operation proportional valve that outputs a pilot pressure corresponding to a control command from the controller 30 and causes the pilot pressure to act on a pilot port of a corresponding control valve in the control valve 17 is used, the actuator may be disabled or limited to very slow operation by disabling a signal from the controller 30 to the operation proportional valve or outputting a deceleration command to the operation proportional valve. Furthermore, when the detected monitoring target object is a truck, control related to stopping or decelerating the actuator may not be performed. For example, the actuator may be controlled to avoid the detected truck. Thus, the type of the detected object may be recognized and the actuator may be controlled based on the recognition.

As a matter of course, the controller 30 may apply the same motion restricting function as in the case of operating the operating device 26, in the case of remotely controlling the shovel 100, in the case where an operation command related to the automatic operation function is output, etc.

The boom bottom pressure sensor 7*a* is attached to the boom cylinder 7 to detect the pressure of its bottom-side oil chamber (hereinafter "boom bottom pressure"), A detection signal corresponding to the boom bottom pressure detected by the boom bottom pressure sensor 7*a* is fed into the controller 30.

The discharge pressure sensor 28 detects the discharge pressure of the main pump 14. A detection signal corresponding to the discharge pressure detected by the discharge pressure sensor 28 is fed into the controller 30.

The operating pressure sensor 29 detects a pilot pressure on the secondary side of the operating device 26, namely, a pilot pressure corresponding to the operating state of each moving element (hydraulic actuator) at the operating device 26 as described above. Detection signals of pilot pressures corresponding to the operating states of the lower traveling structure 1, the upper swing structure 3, the boom 4, the arm 5, the bucket 6, etc., at the operating device 26 generated by the operating pressure sensor 29 are fed into the controller 30.

The display 40 is placed at such a position as to be easily viewable from the sitting operator in the cabin 10, and displays various information images under the control of the controller 30. The display 40 may be connected to the controller 30 via an in-vehicle communications network such as a CAN (Controller Area Network) or connected to the controller 30 via a one-to-one dedicated line.

The input device 42 is provided within the reach of the sitting operator in the cabin 10 to receive various operation inputs made by the operator and output signals corresponding to the operation inputs to the controller 30. The input device 42 may include, for example, a touchscreen provided on the display of the display 40 that displays various information images, a knob switch provided at the top end of a lever portion of a lever device included in the operating device 26, and a button switch, a lever, a toggle, etc., provided around the display 40. More specifically, the input device 42 includes a crane mode switch 42*a*. A signal corresponding to the details of operation on the input device 42 is fed into the controller 30. A signal corresponding to the details of operation on the input device 42 is fed into the controller 30.

The crane mode switch 42*a* is an operation input part for switching the operating mode of the shovel 100 between a normal mode for performing excavation work, etc., and a crane mode for performing crane work using the hook 80. The normal mode is an operating mode of the shovel 100 in which the movement speed of the attachment (for example, the boom 4) responding to the operator's operation through the operating device 26 is relatively fast. The crane mode is an operating mode of the shovel 100 in which the movement speed of the attachment responding to the operator's operation through the operating device 26 is relatively slow. According to this, during crane work, the movement of the boom 4 responding to the operator's operation is relatively slow, for example. Therefore, the shovel 100 can stably hoist and move a suspension load. When the crane mode switch 42*a* is turned on, the controller 30 switches the operating mode of the shovel 100 from the normal mode to the crane mode. When the crane mode switch 42*a* is turned off, the controller 30 switches the operating mode of the shovel 100 from the crane mode to the normal mode.

In the crane mode, for example, the controller 30 sets the rotational speed of the engine 11 to a rotational speed lower than in the case of the normal mode. This enables the controller 30 to make the movement of the attachment slower in the crane mode than in the normal mode.

The storage device 47 is, for example, provided in the cabin 10 to store various kinds of information under the control of the controller 30. The storage device 47 is, for example, a storage medium such as a non-volatile semiconductor memory.

The external sound output device 48 is, for example, provided on the upper swing structure 3 to output a predetermined sound to the outside of the cabin 10, namely, an area surrounding the shovel 100, under the control of the controller 30. Examples of the external sound output device 48 include a loudspeaker and a buzzer. The external sound output device 48 outputs various kinds of information in the form of sound in response to a sound output command from the controller 30.

The hook storage status detector 51 detects the status of storage of the hook 80 into the attachment (the hook storage part 50). The hook storage status detector 51 is, for example, a switch that is closed when the hook 80 is in the hook storage part 50 and is open when the hook 80 is not in the hook storage part 50. The hook storage status detector 51 is connected to the controller 30 through a cable 35, so that the controller 30 can determine whether the hook 80 is stored in the hook storage part 50 based on whether the hook storage status detector 51 is conducting or non-conducting.

The controller 30 may automatically switch the operating mode of the shovel 100 between the crane mode and the normal mode based on information on detection by the hook storage status detector 51. In this case, the crane mode switch 42*a* may be omitted. For example, in response to determining that the hook 80 is extracted from the hook storage part 50 based on the switching of the hook storage status detector 51 from the conducting state to the interrupting state, the controller 30 may switch the operating mode of the shovel 100 from the normal mode to the crane mode. Furthermore, in response to determining that the hook 80 is returned to the hook storage part 50 based on the switching of the hook storage status detector 51 from the interrupting state to the conducting state, the controller 30 may switch the operating mode of the shovel 100 from the crane mode to the normal mode.

The boom pose sensor S1 is attached to the boom 4 to detect the pose angle, specifically, the elevation angle, of the boom 4 relative to the upper swing structure 3 (hereinafter, "boom angle"). The boom pose sensor S1, for example, detects the angle of a straight line connecting the pivot points of the boom 4 at its both ends to the swing plane of the upper swing structure 3 in a side view. Examples of the boom pose sensor S1 may include a rotary encoder, an acceleration sensor, an angular velocity sensor, a six-axis sensor, an IMU (Inertial Measurement Unit), which is also the case with the arm pose sensor S2, the bucket pose sensor S3, and the machine body pose sensor S4. A detection signal corresponding to the boom angle generated by the boom pose sensor S1 is fed into the controller 30.

The arm pose sensor S2 is attached to the arm 5 to detect the pose angle, specifically, the pivot angle, of the arm 5 relative to the boom 4 (hereinafter "arm angle"). The arm pose sensor S2, for example, detects the angle of a straight line connecting the pivot points of the arm 5 at its both ends to the straight line connecting the pivot points of the boom 4 at its both ends in a side view. A detection signal corresponding to the arm angle generated by the arm pose sensor S2 is fed into the controller 30.

The bucket pose sensor S3 is attached to the bucket 6 to detect the pose angle, specifically, the pivot angle, of the bucket 6 relative to the arm 5 (hereinafter "bucket angle"). The bucket pose sensor S3, for example, detects the angle of a straight line connecting the pivot point and the distal end (blade edge) of the bucket 6 to the straight line connecting the pivot points of the arm 5 at its both ends in a side view. A detection signal corresponding to the bucket angle generated by the bucket pose sensor S3 is fed into the controller 30.

The machine body pose sensor S4 detects the pose state of the machine body, specifically, the upper swing structure 3. The machine body pose sensor S4 is, for example, attached to the upper swing structure 3 to detect the pose angles of the upper swing structure 3 about two axes in its longitudinal direction and lateral direction, namely, the tilt angles (hereinafter "longitudinal tilt angle" and "lateral tilt angle") of the upper swing structure 3. Furthermore, the machine body pose sensor S4 detects the pose angle of the upper swing structure 3 about an axis in its vertical direction, namely, the swing angle of the upper swing structure 3 about the swing axis 2X. Detection signals corresponding to the tilt angles (longitudinal tilt angle and lateral tilt angle) and the swing angle generated by the machine body pose sensor S4 are fed into the controller 30.

The front camera S5 (an example of a space recognition device) is, for example, provided at the front end of the upper swing structure 3 (for example, the top of the front end of the cabin 10) to capture an image of an area in front of the upper swing structure 3 during the operation of the shovel 100 from start to stop. Specifically, the front camera S5 is provided on the front of the upper swing structure 3 in such a manner as to be able to cover an imaging range in front of the upper swing structure 3 covering the operating state of the attachment that works in front of the upper swing structure 3. An image captured by the front camera S5 is fed into the controller 30. This enables the controller 30 to capture an image including the work details of the shovel 100 using the attachment, a situation in front of the shovel 100 during work, etc.

In place of or in addition to the front camera S5, another space recognition device for the controller 30 or the like recognizing a situation (space) in front of the upper swing structure 3, such as an ultrasonic sensor, a millimeter wave radar, a LIDAR (Light Detecting and Ranging), a stereo camera, a distance image sensor, an infrared sensor and the like (each being an example of a space recognition device), may be provided. That is, the shovel 100 may include one or more desired space recognition devices for recognizing a situation (space) in front of the upper swing structure 3. Furthermore, in addition to a space recognition device (for example, the front camera S5) for recognizing a situation (space) in front of the upper swing structure 3, a space recognition device corresponding to another direction (for example, at least one direction among the backward, the leftward, and the rightward direction) as seen from the upper swing structure 3 may be provided. This enables the controller 30 to obtain a captured image including a situation to the left or right or behind the shovel 100 during work, etc.

The indoor camera S6 is provided in the cabin 10 to capture an image of the operator. Specifically, the indoor camera S6 is provided in the cabin 10 in such a manner as to be able to cover an imaging range covering how the operator operates the operating device 26 in the cabin 10 and the movements (for example, face orientation, the direction of the light of sight, and the movement of the light of sight) of the operator during operation. An image captured by the indoor camera S6 is fed into the controller 30. This enables the controller 30 to obtain a captured image including the state of the operator's operation of the operating device 26, the state of the operator's movement during operation of the operating device 26, etc.

In place of or in addition to the indoor camera S6, other movement recognition means for the controller 30 or the like recognizing the details of the indoor operator's movement, such as a LIDAR, a stereo camera, a distance image sensor, and an infrared sensor, may be provided.

[Outside Alert Function of Shovel]

Next, the function of alerting a worker, etc., outside the cabin 10 (namely, around the shovel 100) executed by the controller 30 of the shovel 100 (hereinafter "outside alert function") is described with reference to FIGS. 3 through 7.

<Example of Outside Alert Function>

Figure 3:
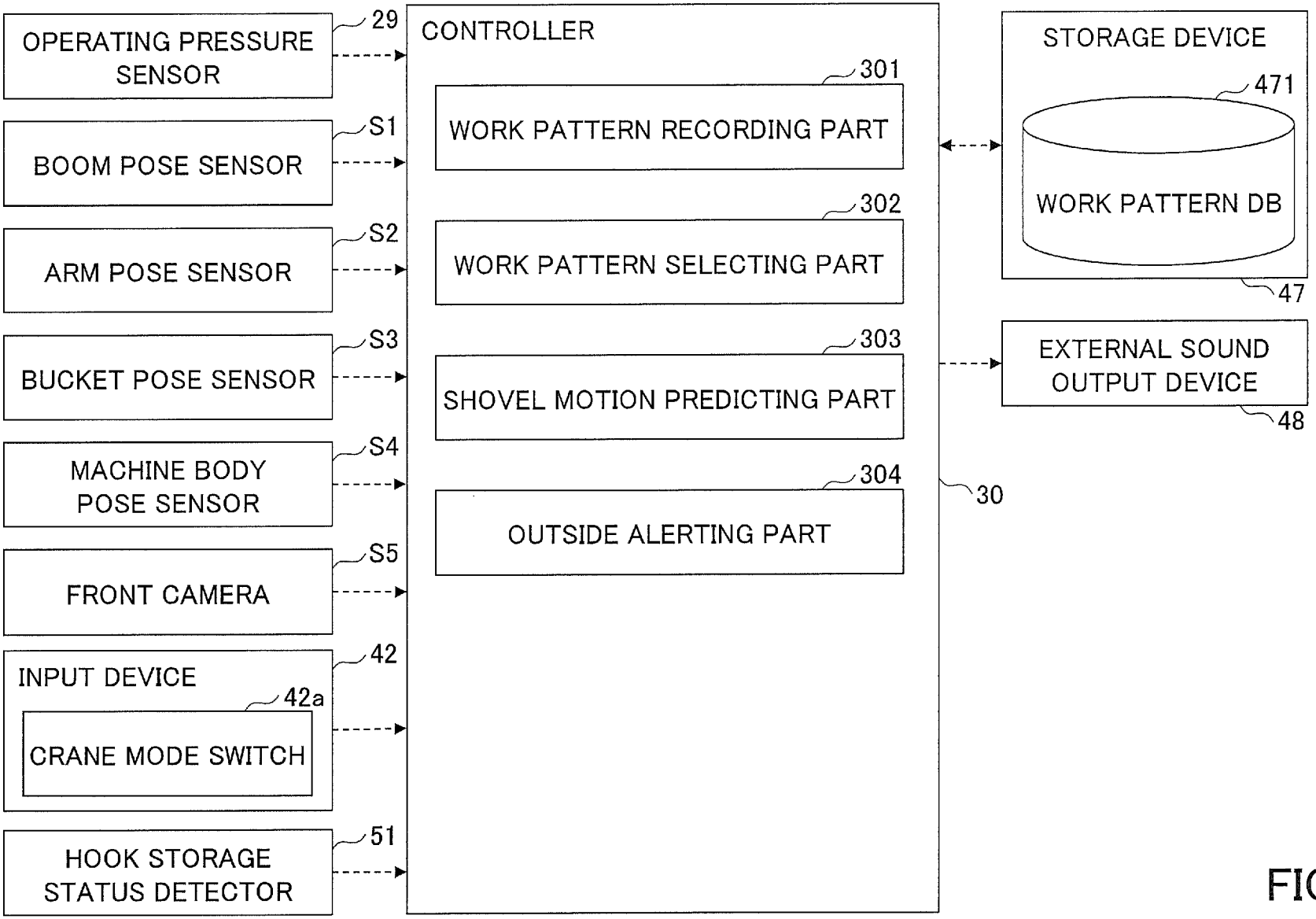
FIG. 3 is a functional block diagram illustrating an example functional configuration associated with the outside alert function of the shovel.

FIG. 3 is a functional block diagram illustrating an example functional configuration associated with the outside alert function of the shovel 100 according to this embodiment.

As illustrated in FIG. 3, the controller 30 includes a work pattern recording part 301, a work pattern selecting part 302, a shovel motion predicting part 303, and an outside alerting part 304 as functional parts implemented by executing a program installed in the non-volatile secondary storage on the CPU, for example.

The work pattern recording part 301 records, in the storage device 47, information on work patterns of the shovel 100 (hereinafter "target work pattern information") including predetermined motions (for example, the traveling motion of the lower traveling structure 1 and the swing motion of the upper swing structure 3) that are targets of prediction by the shovel motion predicting part 303 (hereinafter "prediction target motions"). Specifically, a work pattern DB (database) 471 in which the target work pattern information is organized in such a manner as to be extractable based on predetermined extraction conditions is built in the storage device 47, and the work pattern recording part 301 records the target work pattern information in the work pattern DB 471. A work pattern represents the aggregate of a series of motions that constitute a single piece of work performed by the shovel 100, and as described below, includes multiple motion sections.

The work pattern DB 471 may be built in the non-volatile internal memory of the controller 30. The same applies to a below-described operator movement pattern DB 471A.

The work pattern recording part 301 records, for example, target work pattern information corresponding to one or more target work patterns, input through an external tool or external storage device (for example, a USB (Universal Serial Bus) memory) temporarily connected to the controller 30 by a factory worker or the like before shipment of the shovel 100 from a factory, in the work pattern DB 471 of the storage device 47. Furthermore, for example, a target work pattern may be added after shipment from a factory or a target work pattern may be updated. In this case, the work pattern recording part 301 records, for example, target work pattern information for updating, input through an external tool or external storage device temporarily connected to the controller 30 by a serviceperson, the operator or the like, in the work pattern DB 471 of the storage device 47.

Furthermore, the work pattern recording part 301, for example, may learn (extract) a target work pattern executed (specifically, likely to be executed) by the shovel 100 by machine learning based on the past work details of the shovel 100 and record target work pattern information related to the extracted target work pattern in the work pattern DB 471 of the storage device 47. Specifically, for example, during the operation of the shovel 100 from start to stop, the work pattern recording part 301 stores various kinds of information on the work details of the shovel 100 (for example, detection information, status information, etc., obtained from the boom bottom pressure sensor 7*a*, the operating pressure sensor 29, the input device 42 (for example, the crane mode switch 42*a*), the boom pose sensor S1, the arm pose sensor S2, the bucket pose sensor S3, the machine body pose sensor S4, the front camera S5, and the indoor camera S6) in the storage device 47 or the like. The work pattern recording part 301 may extract a target work pattern executed by the shovel 100 by analyzing the various kinds of information on the past work details of the shovel 100 stored in the storage device 47 or the like at a predetermined time (for example, during the idling of the shovel 100).

Furthermore, the work pattern recording part 301 may extract a target work pattern executed by the shovel 100 in view of the surrounding situation of the shovel 100 when extracting the target work pattern based on the past work details of the shovel 100. Furthermore, the work pattern recording part 301 may extract a target work pattern based on the operator's movement pattern imaged by the indoor camera S6 provided in the cabin 10. This is because even when the purpose of work is the same, the order of motion sections or the motion details of the shovel 100 corresponding to a motion section may differ because of a difference in the surrounding situation of the shovel 100 (for example, a difference between the case of a worksite where the presence of a building, a structure or the like in the surroundings imposes many restrictions on the motion range of the shovel 100 and the case of a worksite with less restrictions on the motion range of the shovel 100 because of the absence of a building, a structure or the like that may come into contact in the surroundings). In this case, the target work pattern information recorded in the work pattern DB 471 of the storage device 47 further includes a determination condition for determining the surrounding situation of the shovel 100 (hereinafter "surrounding situation determining condition").

The process of extracting a target work pattern executed by the shovel 100 based on the past work details of the shovel 100 may also be executed in an external apparatus provided outside the shovel 100 (for example, the below-described management apparatus 300 installed in a management center or the like outside a worksite of the shovel 100 or a management terminal installed in the management office of a worksite or the like). In this case, the controller 30 transmits (uploads) various kinds of information on the work details of the shovel 100 during the operation of the shovel 100 from start to stop to the external apparatus through a predetermined communications device mounted on the shovel 100. This enables the external apparatus to extract a target work pattern executed by the shovel 100. Then, the external apparatus transmits the extracted target work pattern information to the shovel 100, so that the controller 30 (the work pattern recording part 301) can record the target work pattern information corresponding to the target work pattern based on the past work details of the shovel 100 in the work pattern DB 471 of the storage device 47. The same is the case with the below-described process of extracting an operator movement pattern based on the relationship between the past movement details of the operator and motion details of the shovel 100. A work pattern may be input to the work pattern recording part 301 in advance. In this case, the controller 30 may generate an operation command for autonomously controlling the shovel 100 based on this work pattern input in advance. Furthermore, the shovel 100 may communicate with an external apparatus outside the shovel 100 (for example, the below-described assist device 200 and management apparatus 300) using a communications device mounted on the shovel 100. In this case, the communications device may be configured to output a start command related to autonomous control to a functional element of the controller 30 based on a signal received from the external apparatus in order to autonomously control the shovel 100. Furthermore, the communications device may also be configured to output operation command data to a functional element of the controller 30 based on a signal received from the external apparatus. Furthermore, this function of the communications device may be included in the input device 42 mounted on the shovel 100.

As described above, the work pattern DB 471 is built in the storage device 47.

A target work pattern recorded in the work pattern DB 471 may have its series of work details divided into multiple motion sections, for example. Target work pattern information recorded in the work pattern DB 471 includes identification information for identifying a target work pattern (for example, a work pattern ID (identifier)) and motion sections included in the target work pattern. Furthermore, the target work pattern information includes a determination condition for determining whether the target work pattern is executed (started) (hereinafter "work pattern determination condition") and determination conditions for determining the start, the end (or the sign of the end), etc., of a motion section with respect to each motion section (hereinafter "motion section start determining condition," "motion section end determining condition," etc.).

Examples of target work patterns include a work pattern of the shovel 100 with respect to crane work (hereinafter "crane work pattern"). The crane work pattern includes three motion sections that are carried out in order of following (A1) through (A3).

(A1) A motion section corresponding to the state of the shovel 100 where a worker is performing slinging on the hook 80 (namely, the stationary state of the shovel 100 with the boom 4 lowered to a position where the hook 80 is close to the ground) (hereinafter "slinging motion section").

(A2) A motion section in which the shovel 100 hoists a suspended load (namely, where the shovel 100 raises the boom 4) (hereinafter "hoisting motion section").

(A3) A motion section in which the shovel 100 moves the suspended load to a desired position through the traveling motion of the lower traveling structure 1 or the swing motion of the upper swing structure 3 with the suspended load hoisted to a certain height (hereinafter "suspended load moving motion section").

In the case of the crane work pattern, the traveling motion of the lower traveling structure 1 or the swing motion of the upper swing structure 3 in the above-described suspended load moving motion section corresponds to a target motion of prediction by the shovel motion predicting part 303.

Examples of target work patterns further include a work pattern of the shovel 100 with respect to the work of the shovel 100 forming a predetermined slope by cutting (hereinafter "slope forming work pattern"). The slope forming work pattern includes, for example, two motion sections that are repeatedly carried out in order of the following (B1) and (B2). A slope forming work pattern corresponding to the combination of the motion sections is hereinafter referred to as "first slope forming work pattern."

(B1) A motion section in which the shovel 100 repeatedly performs cutting or roller compaction on a slope while pulling the attachment (the bucket 6) to the near side (toward the upper swing structure 3) (hereinafter "slope forming motion section").

(B2) A motion section for moving to stand in front of a non-formed slope to be worked on next with the traveling motion of the lower traveling structure 1 after completion of the slope forming motion section (hereinafter "next work moving motion section").

Furthermore, the slope forming work pattern includes, for example, five motion sections that are repeatedly carried out in order of the following (C1) through (C5). A slope forming work pattern corresponding to the combination of the motion sections is hereinafter referred to as "second slope forming work pattern."

(C1) A motion section in which the shovel 100 performs cutting while pulling the attachment (the bucket 6) to the near side (hereinafter "slope cutting motion section").

(C2) A motion section in which the shovel 100 moves (carries) earth or the like cut from a slope during the slope cutting motion section into the bucket 6 (hereinafter "earth moving motion section").

(C3) A motion section in which the shovel 100 lifts the bucket 6 with earth held in the bucket 6 and swings the upper swing structure 3 (hereinafter "initial swing motion section").

(C4) A motion section in which the shovel 100 stops swinging the upper swing structure 3 and thereafter dumps earth or the like in the bucket 6 onto a predetermined position spaced apart from the slope (hereinafter "earth dumping motion section").

(C5) A motion section in which the shovel 100 swings the upper swing structure 3 to return the upper swing structure 3 (the attachment) to a position right opposite the slope (hereinafter "second swing motion section").

Figure 5:
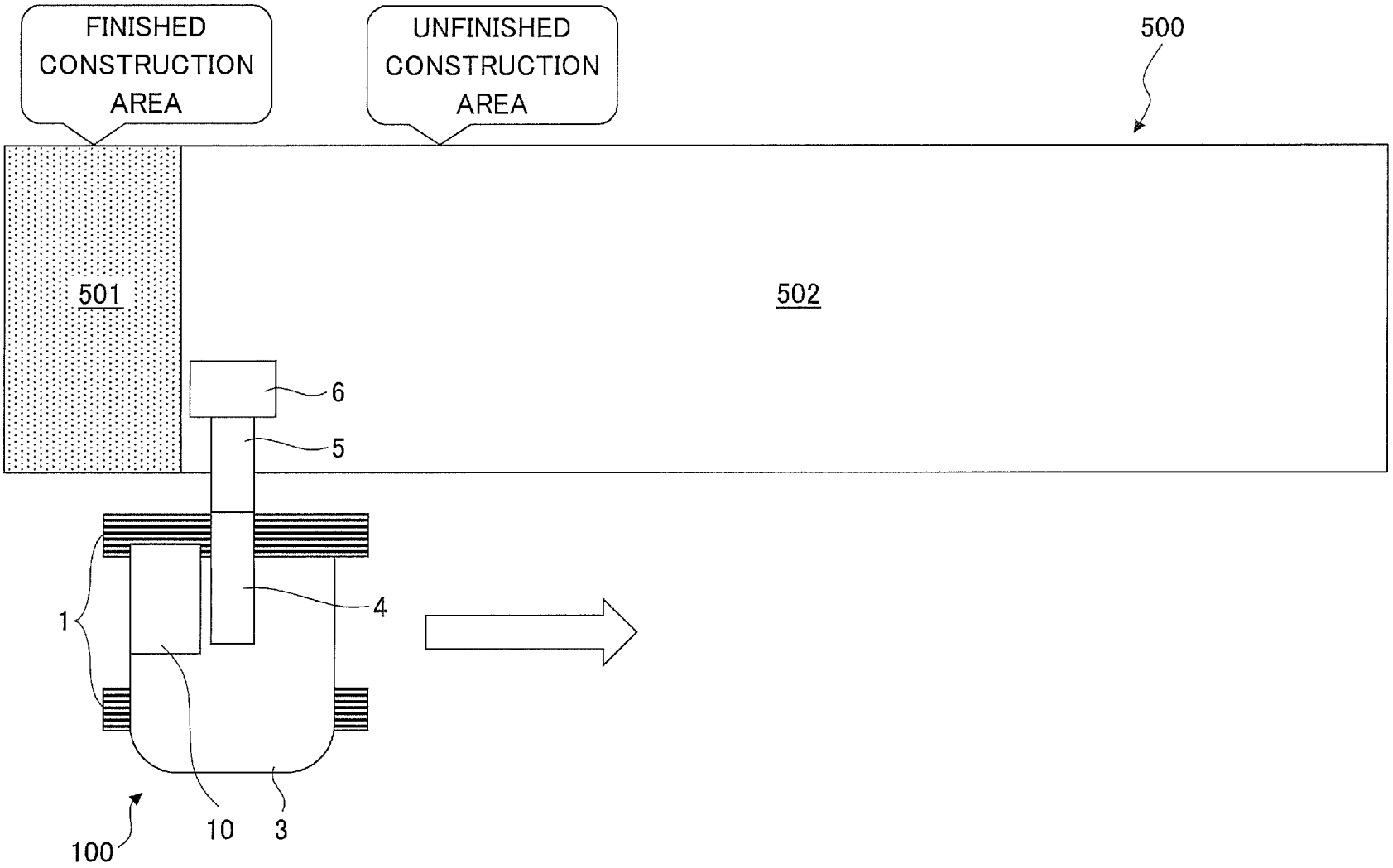
FIG. 5 is a diagram illustrating a specific example of the work situation of the shovel in which outside alerting is performed.

In the case of performing slope forming work by cutting or performing roller compaction on a slope or the like, the shovel 100 orients the traveling direction of the lower traveling structure 1 to a direction in which the slope extends, that is, a direction substantially perpendicular to the longitudinal direction of the upper swing structure 3, while setting the upper swing structure 3 right opposite the slope (see FIG. 5). This allows the shovel 100 to move to stand in front of a non-formed slope and set the upper swing structure 3 right opposite the non-formed slope without swinging the upper swing structure 3 after the work of forming a slope by cutting. Furthermore, the first slope forming work pattern and the second slope forming work pattern are distinguished for convenience. In practice, the first slope forming work pattern and the second slope forming work pattern are combined to perform slope forming work.

The work pattern selecting part 302 compares the output information of the operating pressure sensor 29, the pose sensors S1 through S4, the front camera S5, etc., and multiple items of target work pattern information recorded in the work pattern DB 471 to select a target work pattern corresponding to work that the shovel 100 is performing.

If only one work pattern information item is recorded in the work pattern DB 471, the function of the work pattern selecting part 302 may be omitted.

The shovel motion predicting part 303 (an example of a motion predicting part) predicts the motion of the shovel 100 caused by the operator's operation on the operating device 26. Furthermore, the shovel motion predicting part 303 may also predict the motion of the shovel 100 caused by remote control. Furthermore, the shovel motion predicting part 303 may also predict the motion of the shovel 100 caused by autonomous control (the autonomous operation function). Specifically, the shovel motion predicting part 303 predicts a prediction target motion of the shovel 100, for example, the traveling motion of the lower traveling structure 1 or the swing motion of the upper swing structure 3, based on target work pattern information selected from the target work pattern information recorded in the work pattern DB 471 by the work pattern selecting part 302. More specifically, the shovel motion predicting part 303 detects the end or the sign of the end of a motion section immediately before a motion section in which the shovel 100 performs a prediction target motion (hereinafter "target motion section") (hereinafter "immediately preceding motion section") among the motion sections of a target work pattern based on operation command data, the output information of the pose sensors S1 through S4, the front camera S5, etc., (current motion progress information) and so on. As a result, the shovel motion predicting part 303 can predict that a prediction target motion is going to be performed.

The outside alerting part 304 (an example of an alerting part), when the shovel motion predicting part 303 predicts that a prediction target motion as a motion for which an alert is issued is going to be performed, issues an alert indicating that the prediction target motion is going to be performed to the area surrounding the shovel 100 before the start of the prediction target motion. For example, the outside alerting part 304 outputs a sound output command to the external sound output device 48 to cause the external sound output device 48 to output a predetermined sound, thereby issuing an alert indicating that the prediction target motion is going to be performed to the area surrounding the shovel 100 (for example, to workers around, etc.). The sound output from the external sound output device 48 may be a voice sound such as "SHOVEL WILL SWING (TRAVEL). PLEASE BE CAREFUL" or a predetermined sound such as a buzzing sound that indicates the start of the prediction target motion of the shovel 100. The same is the case with a below-described outside alerting part 304A.

The outside alerting part 304 may issue an alert to the area surrounding the shovel 100 through a method other than sound. For example, the outside alerting part 304 may output a vibration command to a predetermined portable terminal (for example, a terminal dedicated to outside alerting or a general-purpose terminal such as a smartphone) carried by a worker around the shovel 100 through a predetermined communications device and vibrate the portable terminal through remote control. The same is the case with the below-described outside alerting part 304A.

Figure 4A:
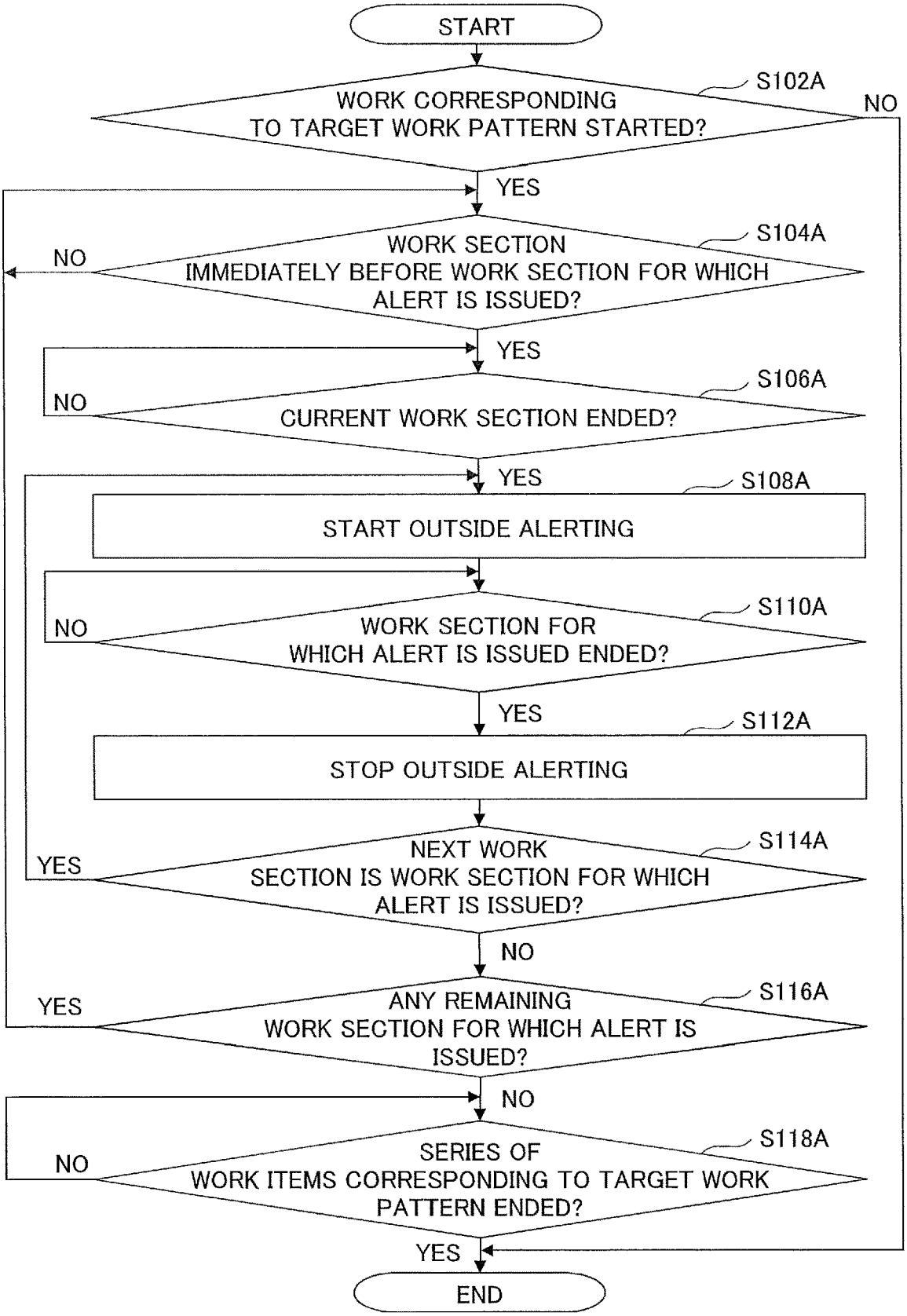
FIG. 4A is a flowchart schematically illustrating an example of an outside alert process executed by a controller of the shovel.
Figure 4B:
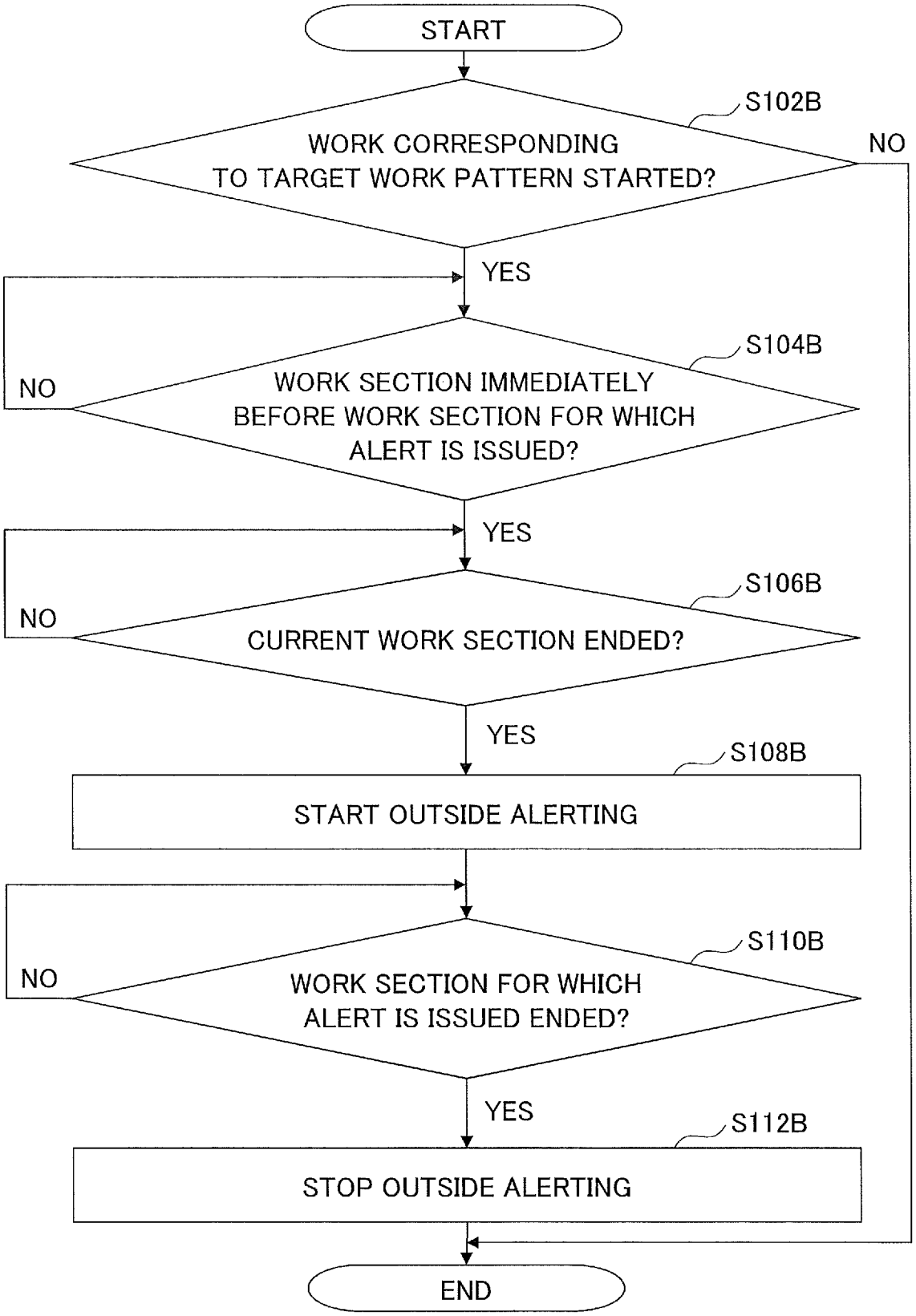
FIG. 4B is a flowchart schematically illustrating an example of the outside alert process executed by the controller of the shovel.

Next, an operation according to this embodiment during slope shaping or forming work or crane work is described with reference to FIGS. 4A and 4B. FIGS. 4A and 4B are flowcharts schematically illustrating examples of processes related to the outside alert function executed by the controller 30 of the shovel 100 according to this embodiment, specifically, outside alert processes executed by the controller 30 of the shovel 100 illustrated in FIG. 3. More specifically, FIG. 4A is a flowchart illustrating a specific example of an outside alert process in the case where multiple motion sections for which an alert is issued (target motion sections) may be included in a target work pattern selected by the work pattern selecting part 302 (for example, a slope forming work pattern). For example, in the case of the second slope forming work pattern, there is the second swing motion section after the first swing motion section with the dumping motion section intervening between them. Furthermore, FIG. 4B is a flowchart illustrating a specific example of an outside alert process in the case where only one motion section for which an alert is issued (target motion sections) is included in a target work pattern selected by the work pattern selecting part 302 (for example, a crane work pattern). The processes according to the flowcharts of FIGS. 4A and 4B are repeatedly executed at predetermined processing intervals during a period from the completion of the initial process of the controller 30 when the shovel 100 starts to the start of the termination process of the controller 30 when the shovel 100 stops, for example. The same is the case with the flowchart of FIG. 7.

The outside alert process of FIG. 4A may also be applied to the case where only one target motion section is included in a target work pattern.

First, as illustrated in FIG. 4A, at step S102A, the work pattern selecting part 302 determines whether work corresponding to a target work pattern recorded in the work pattern DB 471 has been started. Specifically, the work pattern selecting part 302 may determine whether work corresponding to any of the target work patterns has been started, based on whether the above-described work pattern determination condition included in each of the target work pattern information items is satisfied. In other words, the work pattern selecting part 302 determines to which target work pattern recorded in the work pattern DB 471 the current motion of the shovel 100 corresponds. The work pattern selecting part 302 proceeds to step S104A if work corresponding to a target work pattern has been started, and otherwise, ends the processing of this time.

For example, in the case of the slope forming work pattern, the work pattern determination condition is that "the upper swing structure 3 is right opposite a slope and the traveling direction of the lower traveling structure 1 is substantially at right angles to the longitudinal direction of the upper swing structure 3 in a plan view." In this case, the work pattern selecting part 302 can determine whether the work pattern determination condition is satisfied by recognizing a slope based on an image captured by the front camera S5, comparing the recognized slope with preset (pre-recorded) design data, and determining whether the upper swing structure 3 of the shovel 100 is at a slope forming work position based on the result of the comparison. Furthermore, the work pattern selecting part 302 may also determine whether the work pattern determination condition is satisfied by recognizing the relative angle (swing angle) between the traveling direction of the lower traveling structure 1 and the longitudinal direction of the upper swing structure 3 and the orientation and the position of the upper swing structure 3 in the world geodetic system based on the detection information of a positioning device such as a GNSS (Global Navigation Satellite System) sensor and the machine body pose sensor S4 and comparing them with preset design data.

At step S104A, the shovel motion predicting part 303 determines whether the current state of working of the shovel 100 corresponds to a motion section immediately before a target motion section in which a prediction target motion is performed by the shovel 100 (an immediately preceding motion section). Specifically, the shovel motion predicting part 303 may identify a motion section corresponding to the current state of working of the shovel 100 by determining whether the motion section start determining condition is satisfied with respect to each of the motion sections constituting the target work pattern and determine whether the identified motion section is an immediately preceding motion section. The shovel motion predicting part 303 proceeds to step S106A if the current state of working of the shovel 100 corresponds to an immediately preceding motion section, and waits (repeats the process of this step) until the shovel 100 enters a state of working corresponding to an immediately preceding motion section if the current state of working of the shovel 100 does not correspond to an immediately preceding motion section.

For example, in the case of the first slope forming work pattern, the motion section start determining condition with respect to the slope forming motion section serving as an immediately preceding motion section is that "a cutting motion or a roller compaction motion on a slope with the attachment is started." In this case, the shovel motion predicting part 303 can determine whether a cutting motion or a roller compaction motion has been started by recognizing the movement of the attachment relative to a slope based on the detection information of the operating pressure sensor 29, the boom pose sensor S1, the arm pose sensor S2, and the bucket pose sensor S3 or on an image captured by the front camera S5, for example. Furthermore, for example, in the case of the second slope forming work pattern, the motion section start determining condition with respect to the earth moving motion section serving as an immediately preceding motion section is that "the shovel 100 starts to move earth accumulated at the foot of a slope into the bucket 6." In this case, the shovel motion predicting part 303 can determine whether the shovel 100 has started to move earth at the foot of a slope into the bucket 6 by recognizing the movement of the attachment based on the detection information of the operating pressure sensor 29, the boom pose sensor S1, the arm pose sensor S2, and the bucket pose sensor S3 or on an image captured by the front camera S5, for example.

At step S106A, the shovel motion predicting part 303 determines whether the current motion section, namely, an immediately preceding motion section, ends (or shows a sign of ending). Specifically, the shovel motion predicting part 303 may determine whether a motion section end determining condition corresponding to the immediately preceding motion section is satisfied. The shovel motion predicting part 303 proceeds to step S108A if the immediately preceding motion section ends (or shows a sign of ending), and otherwise, waits (repeats the process of this step) until the immediately preceding motion section ends (or shows a sign of ending).

For example, in the case of the first slope forming work pattern, the motion section end determining condition with respect to the slope forming motion section serving as an immediately preceding motion section is that "cutting or roller compaction on a slope in front of the upper swing structure 3 is finished and the movement of the attachment is stopped." In this case, the shovel motion predicting part 303 can determine whether the motion section end determining condition is satisfied by recognizing the progress of slope forming based on an image captured by the front camera S5 and recognizing the state of movement of the attachment based on the detection information of the operating pressure sensor 29, the boom pose sensor S1, the arm pose sensor S2, the bucket pose sensor S3, etc., for example. Furthermore, for example, in the case of the second slope forming work pattern, the motion section end determining condition with respect to the earth moving motion section serving as an immediately preceding motion section is that "the shovel 100 starts lifting the bucket 6 with earth being held in the bucket 6." In this case, the shovel motion predicting part 303 can determine whether the motion section end determining condition is satisfied by recognizing the movement of the attachment based on the detection information of the operating pressure sensor 29, the boom pose sensor S1, the arm pose sensor S2, and the bucket pose sensor S3 or on an image captured by the front camera S5, for example.

At step S108A, the outside alerting part 304 starts issuing an alert indicating that a prediction target motion, namely, the swing motion or traveling motion of the shovel 100, is going to be performed to the outside of (the area surrounding) the shovel 100 by outputting a sound output command to the external sound output device 48. Thereafter, a motion corresponding to the target motion section (namely, the swing motion or traveling motion) is started by the operator operating a lever device for swinging or a lever device for traveling.

At step S110A, the shovel motion predicting part 303 determines whether the target motion section has ended. Specifically, the shovel motion predicting part 303 determines whether the motion section end determining condition with respect to the target motion section is satisfied. The shovel motion predicting part 303 proceeds to step S112A if the target motion section has ended, and otherwise, waits (repeats the process of this step) until the target motion section ends.

At step S112A, the outside alerting part 304 stops the above-described alerting by outputting a sound output stop command to the external sound output device 48.

At step S114A, the shovel motion predicting part 303 determines whether the next motion section is a target motion section. This is because if there are multiple prediction target motions, there may be successive target motion sections depending on target work patterns. The shovel motion predicting part 303 returns to step S108A to start issuing another alert to the area surrounding the shovel 100 if the next motion section is a target motion section, and proceeds to step S116A if the next motion section is not a target motion section.

At step S116A, the shovel motion predicting part 303 determines whether a target motion section (for example, the next traveling motion section if a traveling motion continues) remains in a target work pattern corresponding to the details of work that the shovel 100 is performing. The shovel motion predicting part 303 returns to step S104A to repeat the process of step S104A and the subsequent steps if a target motion section remains in a target work pattern corresponding to the details of work that the shovel 100 is performing, and proceeds to step S118A if no target motion section remains.

At step S118A, the shovel motion predicting part 303 determines whether a series of work items corresponding to the target work pattern has ended. Specifically, the shovel motion predicting part 303 may determine whether a series of work items corresponding to the target work pattern has ended based on whether the motion section end determining condition with respect to a motion section that is carried out last among the multiple motion sections constituting the target work pattern is satisfied. If a series of work items corresponding to the target work pattern has not ended, the shovel motion predicting part 303 waits (repeats the process of this step) until its end. The shovel motion predicting part 303 ends the processing of this time if series of work items corresponding to the target work pattern has ended.

For example, FIG. 5 is a diagram illustrating a specific example of the work situation of the shovel 100 in the case where outside alerting is performed, and more specifically, is a diagram illustrating the work situation of the shovel 100 with respect to the slope forming work pattern (first slope forming work pattern) that is an example target work pattern.

As illustrated in FIG. 5, according to the first slope forming work pattern, as described above, the operator causes the upper swing structure 3 to stand right opposite a slope 500 to be worked on and place the lower traveling structure 1 such that its traveling direction is substantially parallel to the extending direction of the slope 500 (namely, substantially at right angles to the longitudinal direction of the upper swing structure 3). For example, the operator determines that the upper swing structure 3 is right opposite a slope (target construction surface) in response to determining that a work plane of the attachment includes a normal of the slope (target construction surface).

According to this example, the shovel 100 is operated by the operator to repeat a work procedure in which the shovel 100 performs slope forming work on an unfinished construction area 502 in front of the upper swing structure 3, and when it is finished, moves rightward to again perform slope forming work on the unfinished construction area 502. As a result, finished construction areas 501 are sequentially formed from the left end of the slope 500.

In this situation, it is possible that workers, etc., around the shovel 100 may have difficulty in determining when the shovel 100 starts traveling rightward because of, for example, difficulty in establishing eye contact with the operator in the cabin 10.

To address this, as described above, the shovel motion predicting part 303 predicts that the shovel 100 is going to perform a traveling motion by determining the end of a motion section (slope forming motion section) immediately before the start of the traveling motion of the shovel 100. The outside alerting part 304 can announce that the shovel 100 is going to perform (start) a traveling motion through the external sound output device 48 before the shovel 100 starts a traveling motion corresponding to a target motion section. Accordingly, workers, etc., around the shovel 100 can determine when the shovel 100 starts to travel rightward even in a situation where it is difficult to determine when the shovel 100 starts to travel.

Furthermore, as illustrated in FIG. 4B, at step S102B, the work pattern selecting part 302 determines whether work corresponding to a target work pattern recorded in the work pattern DB 471 has been started, the same as in the case of step S102A of FIG. 4A. The work pattern selecting part 302 proceeds to step S104B if work corresponding to a target work pattern has been started, and otherwise, ends the processing of this time.

For example, in the case of the crane work pattern, the work pattern determination condition is that "the hook 80 for crane work has been taken out of the hook storage part 50" or that "the operating mode of the shovel 100 has been switched from the normal mode to the crane mode." In this case, whether the hook 80 is out of the hook storage part 50 may be determined based on the detection information of the hook storage status detector 51 such as a proximity switch or a space recognition device such as the front camera S5, a LIDAR, or a millimeter wave radar.

At step S104B, the shovel motion predicting part 303 determines whether the current state of working of the shovel 100 corresponds to a motion section immediately before a target motion section in which a prediction target motion is performed by the shovel 100 (an immediately preceding motion section), the same as in the case of step S104A of FIG. 4A. The shovel motion predicting part 303 proceeds to step S106B if the current state of working of the shovel 100 corresponds to an immediately preceding motion section, and waits (repeats the process of this step) until the shovel 100 enters a state of working corresponding to an immediately preceding motion section if the current state of working of the shovel 100 does not correspond to an immediately preceding motion section.

For example, in the case of the crane work pattern, the motion section start determining condition with respect to the hoisting motion section serving as an immediately preceding motion section is that "the boom 4 starts a rising movement with a load being on (suspended from) the hook 80." In this case, the shovel motion predicting part 303 can determine whether the motion section start determining condition is satisfied by, for example, measuring the weight of a load based on the detection information of the boom bottom pressure sensor 7*a* to determine the presence or absence of a load on the hook 80 and recognizing the movement of the boom 4 based on the detection information of the boom pose sensor S1 or the operating pressure sensor 29 corresponding to the operation of the boom 4 (the boom cylinder 7).

At step S106B, the shovel motion predicting part 303 determines whether the current motion section, namely, an immediately preceding motion section, ends (or shows a sign of ending), the same as in the case of step S106A of FIG. 4A. The shovel motion predicting part 303 proceeds to step S108B if the immediately preceding motion section ends (or shows a sign of ending), and otherwise, waits (repeats the process of this step) until the immediately preceding motion section ends (or shows a sign of ending).

For example, in the case of crane work pattern, the motion section end determining condition with respect to the hoisting motion section serving as an immediately preceding motion section is that "the rising motion of the boom 4 has stopped at a position higher than a predetermined height or has decelerated into a state corresponding to a state immediately before stopping after the start of the hoisting motion section." In this case, the shovel motion predicting part 303 can determine whether the motion section end determining condition is satisfied by recognizing the movement speed of the boom 4 or the position of the bucket 6 (the position of the suspended load) based on the detection information of the boom pose sensor S1, the arm pose sensor S2, and the bucket pose sensor S3 or of the operating pressure sensor 29 corresponding to the operation of the boom 4.

At step S108B, the outside alerting part 304 starts issuing an alert indicating that a prediction target motion, namely, the swing motion or traveling motion of the shovel 100, is going to be performed to the outside of (the area surrounding) the shovel 100 by outputting a sound output command to the external sound output device 48, the same as in the case of step S108A of FIG. 4A.

At step S110B, the shovel motion predicting part 303 determines whether the target motion section has ended, the same as in the case of step S110A of FIG. 4A. The shovel motion predicting part 303 proceeds to step S112B if the target motion section has ended, and otherwise, waits (repeats the process of this step) until the target motion section ends.

At step S112B, the outside alerting part 304 stops the above-described alerting by outputting a sound output stop command to the external sound output device 48, and ends the processing of this time.

This makes it possible for the outside alerting part 304 to announce that the swing motion or the like of the shovel 100 is going to be performed (started) before the shovel 100 performs a swing motion or the like the same as in the case of FIG. 4A, even when there is only one target motion section for which outside alerting is performed as in the case of crane work, for example. Accordingly, workers, etc., around the shovel 100 can determine when the shovel 100 starts to perform swinging, etc., even in a situation where it is difficult to determine when the shovel 100 starts to perform swinging, etc.

Thus, according to this example, the shovel motion predicting part 303 predicts the motion of the shovel 100. When the shovel motion predicting part 303 predicts that the shovel 100 next performs a predetermined motion (for example, a traveling motion or a swing motion), the outside alerting part 304 issues an alert indicating that the predetermined motion is going to be performed to the area surrounding the shovel 100 before the start of the predetermined motion.

This enables the shovel 100 to encourage workers, etc., around to be aware of the motion of the shovel 100 caused by the operator's operation.

Furthermore, normally, when the shovel 100 performs a traveling motion or a swing motion, the relative distance between the shovel 100 and a monitoring target object such as a person may decrease to have the monitoring target object such as a person enter the monitoring area of the surroundings monitoring function. In this case, the above-described motion restricting function operates to stop or decelerate the operation of an actuator of the shovel 100. Furthermore, the presence of a monitoring target object (for example, a worker around the shovel 100) is announced to the operator in the cabin 10 or the area surrounding the shovel 100 by the above-described object detection announcing function. In response, workers around the shovel 100 evacuate the monitoring area, and the motion restricting function is canceled automatically in response to the workers' evacuation from the monitoring area or in response to the operation of the operator of the shovel 100 who has confirmed the workers' evacuation from the monitoring area. Therefore, work performed by the shovel 100 and workers may be temporarily suspended to reduce the work efficiency of the shovel 100 and workers.

In contrast, according to this embodiment, the controller 30 can alert workers around the shovel before the shovel 100 performs a traveling motion or a swing motion. This makes it possible for workers to evacuate in a direction away from the shovel 100 before the traveling motion or swing motion of the shovel 100 through alerting. Therefore, the shovel 100 can relatively reduce the frequency of putting the motion restricting function into operation to prevent a decrease in work efficiency due to the stoppage or deceleration of the motion of the shovel 100. Furthermore, because workers can evacuate in advance, the shovel 100 can prevent a decrease in the work efficiency of workers.

Furthermore, according to this example, the shovel motion predicting part 303 predicts the motion of the shovel 100 based on a work pattern that the shovel 100 is executing.

This enables the shovel motion predicting part 303 to predict the motion of the shovel 100 along the flow of a series of motions corresponding to the work pattern that the shovel 100 is executing.

Furthermore, according to this example, when the shovel 100 performs a motion corresponding to one motion section (immediately preceding motion section) among multiple motion sections constituting a work pattern that the shovel 100 is executing, the shovel motion predicting part 303 predicts that the shovel 100 next performs a motion (prediction target motion) corresponding to another motion section (target motion section) next to the one motion section.

This enables the shovel motion predicting part 303 to determine which motion section the shovel 100 is carrying out among the motion sections corresponding to the work pattern that the shovel 100 is executing and specifically predict the next motion of the shovel 100.

Furthermore, the shovel motion predicting part 303 predicts the motion of the shovel 100 based on a work pattern that the shovel 100 is currently executing among the work patterns of the shovel 100 determined from the past work details of the shovel 100.

This enables the shovel motion predicting part 303 to predict the motion of the shovel 100 in view of the past work details of the shovel 100.

<Another Example of Outside Alert Function>

Figure 6:
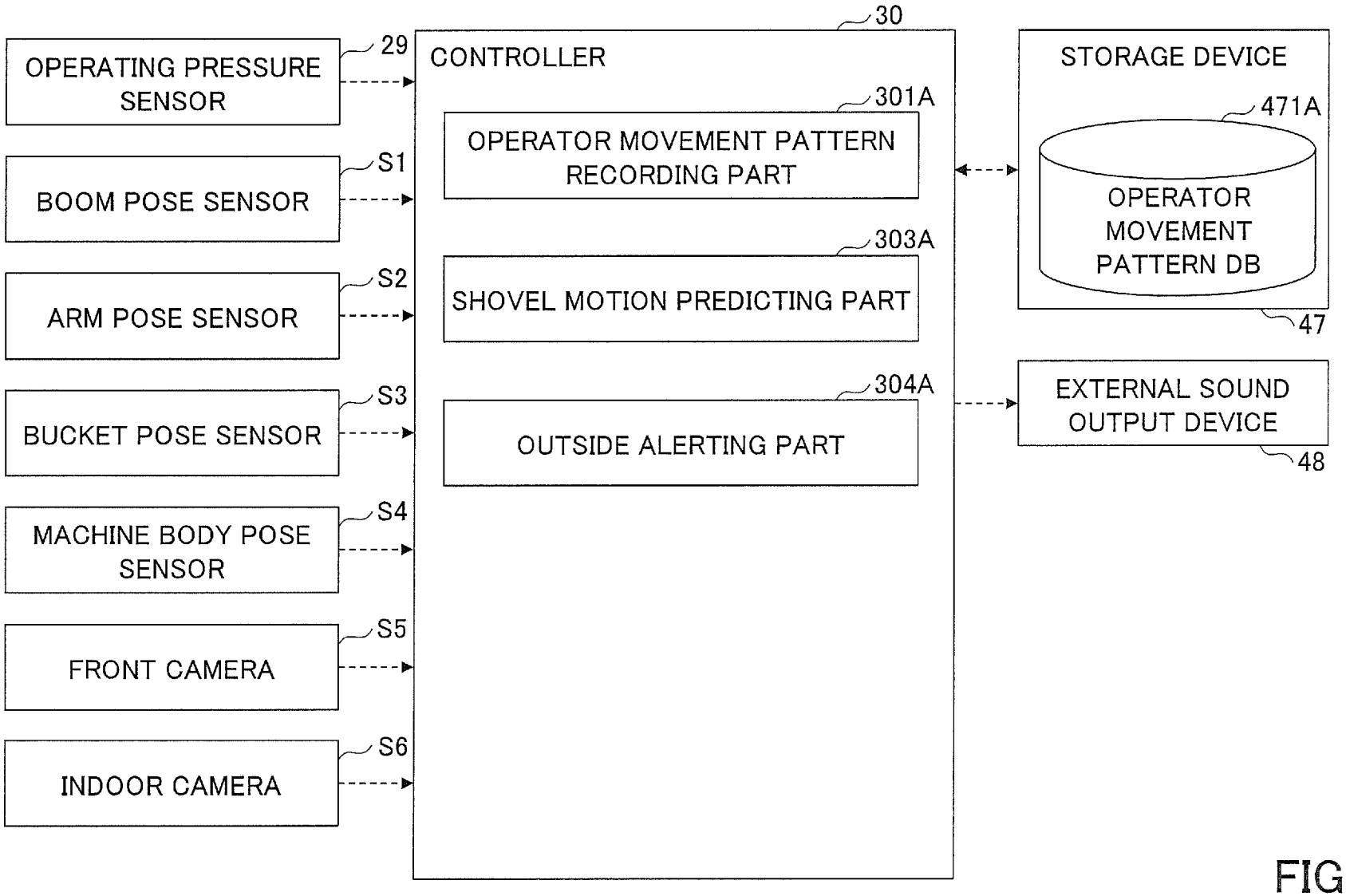
FIG. 6 is a functional block diagram illustrating another example functional configuration associated with the outside alert function of the shovel.

FIG. 6 is a functional block diagram illustrating another example functional configuration associated with the outside alert function of the controller 30.

As illustrated in FIG. 6, the controller 30 includes an operator movement pattern recording part 301A, a shovel motion predicting part 303A, and the outside alerting part 304A as functional parts implemented by executing one or more programs installed in the non-volatile secondary storage on the CPU, for example.

The operator movement pattern recording part 301A records information on a movement pattern of the operator (hereinafter "operator movement pattern") in the case where the shovel 100 performs a prediction target motion (hereinafter "operator movement pattern information") in the storage device 47. Specifically, the operator movement pattern DB 471A in which the operator movement pattern information is organized in such a manner as to be extractable based on predetermined extraction conditions is built in the storage device 47, and the operator movement pattern recording part 301A records the operator movement pattern information in the operator movement pattern DB 471A.

The operator movement pattern information recorded in the operator movement pattern DB 471A includes, for example, a movement condition corresponding to an operator movement pattern immediately before the operator causes the shovel 100 to perform a prediction target movement (hereinafter, an operator movement condition). For example, when the prediction target motion is the traveling motion of the shovel 100, the operator movement condition is "moving a hand to a lever device for traveling or a foot to a pedal device for traveling while checking the area surrounding the shovel 100 (for example, looking around)." Furthermore, for example, when the prediction target motion is the swing motion of the shovel 100, the operator movement condition is "checking the surrounding area (for example, looking around) while keeping the same posture facing the front."

The operator movement pattern recording part 301A records, for example, operator movement pattern information corresponding to one or more operator movement patterns, input through an external tool or external storage device temporarily connected to the controller 30 by a factory worker or the like before shipment of the shovel 100 from a factory, in the operator movement pattern DB 471A of the storage device 47. Furthermore, for example, an operator movement pattern may be added after shipment from a factory or an operator movement pattern may be updated. In this case, the operator movement pattern recording part 301A records, for example, operator movement pattern information for updating, input through an external tool or external storage device temporarily connected to the controller 30 by a serviceperson, the operator or the like, in the operator movement pattern DB 471A of the storage device 47.

Furthermore, the operator movement pattern recording part 301A, for example, may learn (extract) an operator movement pattern from the past movement details of the operator by machine learning based on the relationship between the past movements of the operator and motions of the shovel 100, and record operator movement pattern information related to the extracted operator movement pattern in the operator movement pattern DB 471A of the storage device 47. Specifically, for example, during the operation of the shovel 100 from start to stop, the operator movement pattern recording part 301A stores information on the movement details of the operator (for example, an image captured by the indoor camera S6) and various kinds of information on the work details of the shovel 100 (for example, detection information, status information, etc., obtained from the boom bottom pressure sensor 7*a*, the operating pressure sensor 29, the input device 42 (for example, the crane mode switch 42*a*), the boom pose sensor S1, the arm pose sensor S2, the bucket pose sensor S3, the machine body pose sensor S4, and the front camera S5) in the storage device 47 or the like. The operator movement pattern recording part 301A may extract an operator movement pattern corresponding to a prediction target motion of the shovel 100 by analyzing the relationship between the past movement details of the operator and motion details of the shovel 100 stored in the storage device 47 or the like at a predetermined time (for example, during the idling of the shovel 100).

Furthermore, the operator movement pattern recording part 301A may extract an operator movement pattern in view of the surrounding situation of the shovel 100 when extracting the operator movement pattern based on the relationship between the past movement details of the operator and motion details of the shovel 100. This is because even when the operator causes the shovel 100 to perform the same prediction target operation, the movement details of the operator may differ because of a difference in the surrounding situation of the shovel 100. In this case, the operator movement pattern information recorded in the operator movement pattern DB 471A of the storage device 47 further includes a determination condition for determining the surrounding situation of the shovel 100 (hereinafter "surrounding situation determining condition").

Furthermore, when there are multiple operators who operate the shovel 100, the operator movement pattern recording part 301A may extract an operator movement pattern operator by operator based on the relationship between the past movement details of the operators and motion details of the shovel 100. This is because the movement details during the operation of the shovel 100 may differ from operator to operator because of their personal differences and habits.

The shovel motion predicting part 303A (an example of a motion predicting part) predicts the motion of the shovel 100 caused by the operator's operation on the operating device 26. Specifically, the shovel motion predicting part 303A predicts that a prediction target motion is going to be performed based on operator movement pattern information recorded in the operator movement pattern DB 471A of the storage device 47. More specifically, the shovel motion predicting part 303A monitors the movement of the operator based on an image captured by the indoor camera S6 and predicts that a prediction target motion is going to be performed based on whether the operator is making a movement corresponding to an operator movement pattern.

The outside alerting part 304A (an example of an alerting part), when the shovel motion predicting part 303A predicts that a prediction target motion is going to be performed, issues an alert indicating that the prediction target motion is going to be performed to the area surrounding the shovel 100 through the external sound output device 48 or the like before the start of the prediction target motion.

Figure 7:
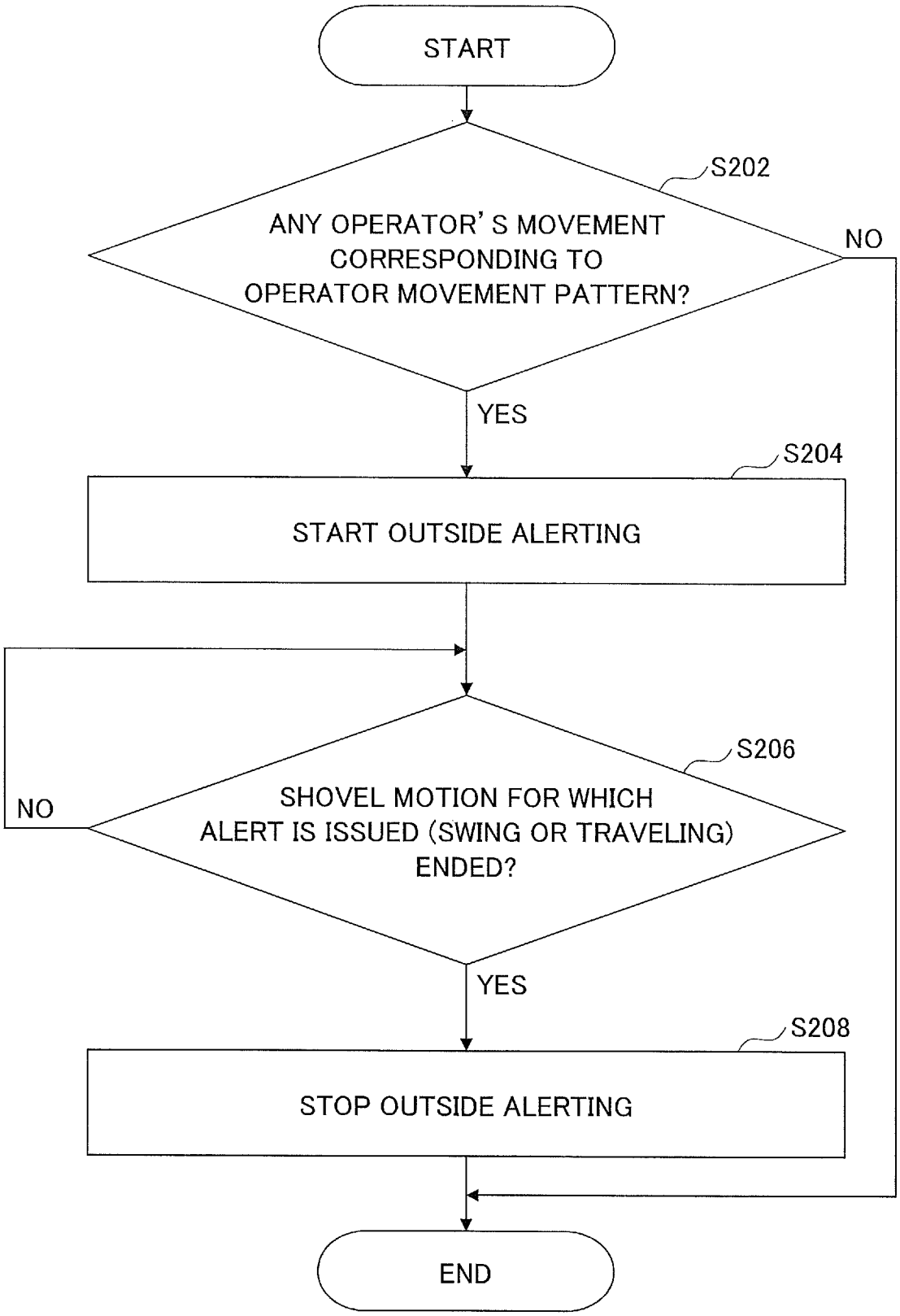
FIG. 7 is a diagram illustrating another example of the outside alert process executed by the controller of the shovel.

Next, FIG. 7 is a flowchart schematically illustrating another example of the outside alert process executed by the controller 30.

At step S202, the shovel motion predicting part 303A determines whether the operator is making a movement corresponding to an operator movement pattern based on an image captured by the indoor camera S6. The shovel motion predicting part 303A proceeds to step S204 if the operator is making a movement corresponding to an operator movement pattern, and otherwise, ends the processing of this time.

A description of the process of step S204, which is equal to the process of steps S108A and S108B of FIGS. 4A and 4B, is omitted.

At step S206, the shovel motion predicting part 303A determines whether the motion of the shovel for which an alert is issued (for example, a prediction target motion of the shovel 100, such as the traveling motion, the swing motion or the like) has ended. At this point, for example, the shovel motion predicting part 303A can recognize the traveling state of the shovel 100 (the lower traveling structure 1) based on the detection information of the operating pressure sensor 29 corresponding to the lower traveling structure (the travel hydraulic motors 1L and 1R) or the like. Furthermore, for example, the shovel motion predicting part 303A can recognize the swing state of the shovel 100 (the upper swing structure 3) based on the detection information of the operating pressure sensor 29 or the machine body pose sensor S4 corresponding to the upper swing structure 3 (the swing hydraulic motor 2A) or the like. The shovel motion predicting part 303A proceeds to step S208 if the prediction target motion has ended, and waits (repeats the process of this step) until the prediction target motion ends if the prediction target motion has not ended.

A description of the process of step S208, which is equal to the process of steps S112A and S112B of FIGS. 4A and 4B, is omitted.

Thus, according to this example, the shovel motion predicting part 303A predicts the motion of the shovel 100 by monitoring the movement of the operator.

This enables the shovel motion predicting part 303A to, for example, predict an operation to be performed next by monitoring the movement of the operator based on an image captured by the indoor camera S6, and therefore, to specifically predict the motion of the shovel 100.

Furthermore, according to this example, the shovel motion predicting part 303A monitors the movement of the operator based on the relationship between the past movement details of the operator and motion details of the shovel 100 to predict the motion of the shovel 100.

This enables the shovel motion predicting part 303A to identify, for example, an operator movement pattern in the case where a predetermined motion for which an alert is issued is going to be performed from the relationship between the past movement details of the operator and motion details of the shovel 100. Accordingly, the shovel motion predicting part 303A can specifically predict the motion of the shovel 100 based on whether a movement corresponding to the identified operation pattern has been made by the operator by monitoring the movement of the operator.

[Shovel Management System]

Next, a shovel management system SYS is described with reference to FIG. 8.

Figure 8:
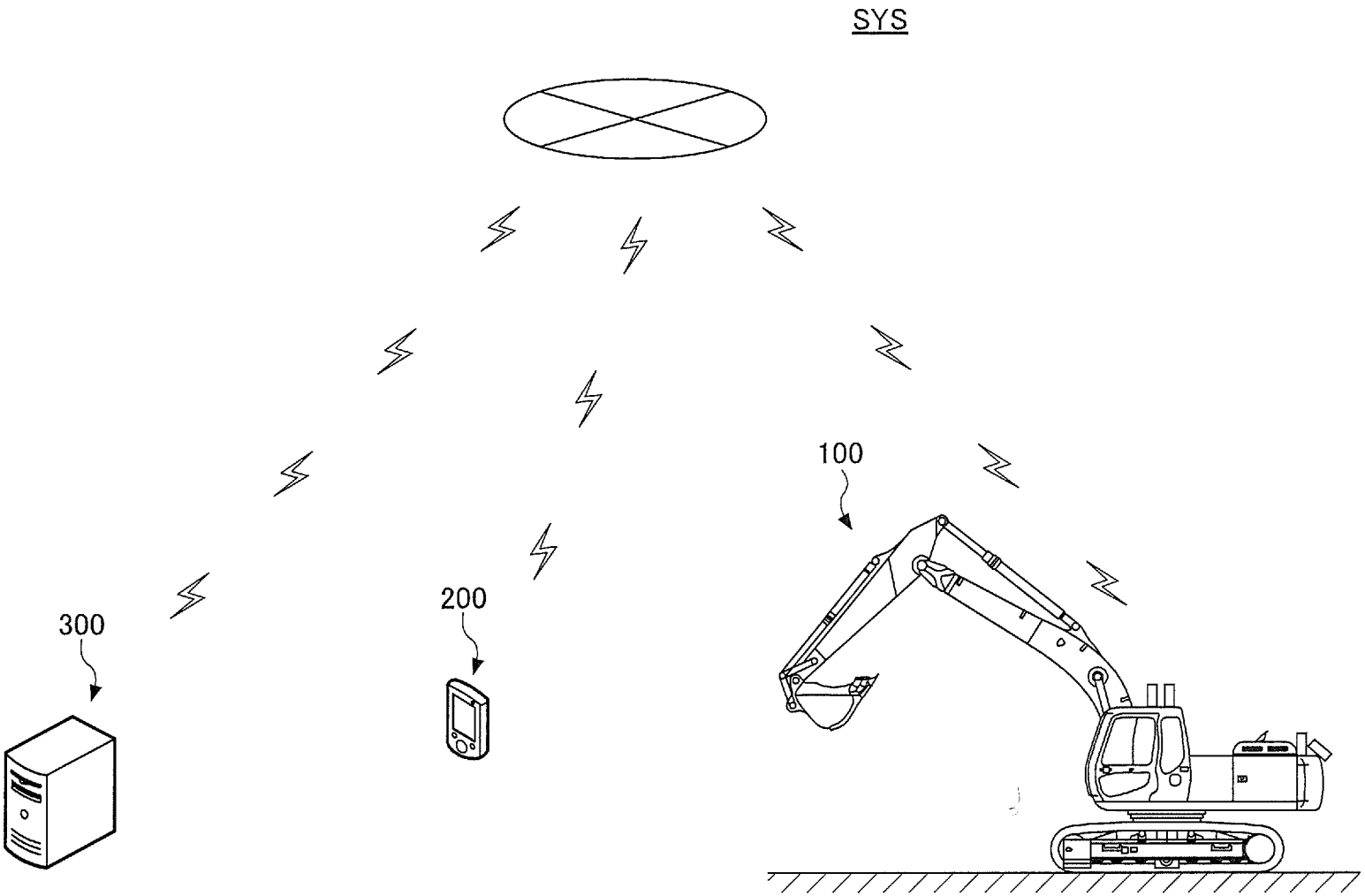
FIG. 8 is a diagram illustrating an example of a shovel management system.

FIG. 8 is a schematic diagram illustrating an example of the shovel management system SYS.

As illustrated in FIG. 8, the shovel management system SYS includes the shovel 100, the assist device 200, and the management apparatus 300. The shovel management system SYS is a system that manages one or more shovels 100.

Information obtained by the shovel 100 may be shared with a manager, other shovel operators, etc., through the shovel management system SYS. The number of shovels 100, the number of assist devices 200, and the number of management apparatuses 300 constituting the shovel management system SYS may be one or more. According to this example, the shovel management system SYS includes the single shovel 100, the single assist device 200, and the single management apparatus 300.

The assist device 200 is typically a portable terminal device, and is, for example, a laptop computer terminal, a tablet terminal, a smartphone or the like carried by a worker or the like at a construction site. The assist device 200 may also be a portable terminal carried by the operator of the shovel 100. The assist device 200 may also be a stationary terminal device.

The management apparatus 300 is typically a stationary terminal apparatus, and is, for example, a server computer installed in a management center or the like outside a construction site (a so-called cloud server). The management apparatus 300 may also be, for example, an edge server installed at a construction site. Furthermore, the management apparatus 300 may also be a portable terminal device (for example, a portable terminal such as a laptop computer terminal, a tablet terminal, or a smartphone).

At least one of the assist device 200 and the management apparatus 300 includes a monitor and an operating device for remote control. In this case, an operator using the assist device 200 or the management apparatus 300 may operate the shovel 100 while using the operating device for remote control. The operating device for remote control is connected to the controller 30 installed in the shovel 100 in such a manner as to be able to communicate with the controller 30 through a radio communication network such as a short-range communication network, a mobile communication network, a satellite communication network, or the like.

Furthermore, various information images displayed on the display 40 installed in the cabin 10 (for example, image information showing the surroundings of the shovel 100, various settings screens, etc.) may be displayed on a display connected to at least one of the assist device 200 and the management apparatus 300. The image information showing the surroundings of the shovel 100 may be generated based on an image captured by the front camera S5. This enables a worker using the assist device 200, a manager using the management apparatus 300, or the like to remotely control the shovel 100 and configure various settings related to the shovel 100 while checking the surroundings of the shovel 100.

For example, according to the shovel management system SYS, the controller 30 of the shovel 100 may transmit information on at least one of the time and location of the pressing of an autonomous travel switch, a target route used when the shovel 100 is caused to autonomously move (during autonomous travel), a trajectory actually followed by a predetermined part during autonomous travel, etc., to at least one of the assist device 200 and the management apparatus 300. In this case, the controller 30 may transmit the output of a space recognition device (for example, an image captured by the front camera S5) to at least one of the assist device 200 and the management apparatus 300. The captured image may be multiple images captured during autonomous travel. Furthermore, the controller 30 may transmit information on at least one of data on the motion details of the shovel 100, data on the pose of the shovel 100, data on the pose of the attachment, etc., during autonomous travel to at least one of the assist device 200 and the management apparatus 300. This enables a worker using the assist device 200 or a manager using the management apparatus 300 to access information on the shovel 100 during autonomous travel.

Thus, the shovel management system SYS may make it possible to share information on the shovel 100 obtained during remote control or autonomous control with a manger and other shovel operators.

[Variations and Modifications]

An embodiment is described in detail above. The present disclosure, however, is not limited to the specific embodiment, and variations and modifications may be made without departing from the scope of the present invention.

For example, according to the above-described embodiment, the shovel 100 is configured to hydraulically drive all moving elements such as the lower traveling structure 1, the upper swing structure 3, the boom 4, the arm 5, and the bucket 6. The shovel 100, however, may also be configured to electrically drive one or more moving elements. That is, configurations, etc., disclosed in the above-described embodiment may also be applied to hybrid shovels, electric shovels, etc.

What is claimed is:

1. A controller for a shovel, comprising:

processing circuitry configured to predict a motion of the shovel; and in response to predicting, based on a work pattern being executed by the shovel, that the shovel next performs a predetermined motion, issue an alert indicating that the predetermined motion is to be performed to an area surrounding the shovel before a start of the predetermined motion, the work pattern representing a flow of a plurality of motions of the shovel that constitute a single piece of work performed by the shovel and are carried out in order, the work pattern being divided into a plurality of motion sections corresponding to the plurality of motions, wherein each of the plurality of motion sections is defined by a start and an end, and a start determining condition for determining the start of each of the plurality of motion sections and an end determining condition for determining the end of each of the plurality of motion sections are recorded in association with the work pattern.

2. The controller as claimed in claim 1, wherein the processing circuitry is further configured to predict, when the shovel performs a motion corresponding to one motion section among the plurality of motion sections of the work pattern being executed by the shovel, that the shovel next performs a motion corresponding to another motion section next to said one motion section.

3. The controller as claimed in claim 1, wherein the processing circuitry is further configured to predict the motion of the shovel based on the work pattern being executed by the shovel among work patterns of the shovel determined from past work details of the shovel.

4. The controller as claimed in claim 1, wherein the processing circuitry is further configured to predict the motion of the shovel by monitoring a movement of an operator.

5. The controller as claimed in claim 4, wherein the processing circuitry is further configured to predict the motion of the shovel by monitoring the movement of the operator based on a relationship between past movement details of the operator and motion details of the shovel.

6. The controller as claimed in claim 1, wherein the predetermined motion is a traveling motion or a swing motion of the shovel.

7. The controller as claimed in claim 1, wherein the processing circuitry is further configured to issue the alert when a motion section immediately before a motion section corresponding to the predetermined motion among the plurality of motion sections ends or shows a sign of ending.

8. The controller as claimed in claim 1, wherein the processing circuitry is further configured to disable an actuator of the shovel when it is determined, based on information obtained by a space recognition device of the shovel, that a person is present within a predetermined area from the shovel before the actuator starts operating, the actuator being configured to drive the shovel, the space recognition device being configured to recognize a situation in surroundings of the shovel.

9. The controller as claimed in claim 1, wherein the processing circuitry is further configured to prevent an actuator of the shovel from being driven in response to an operation of an operating device of the shovel when it is determined, based on information obtained by a space recognition device of the shovel, that a person is present within a predetermined area from the shovel before the actuator starts operating, the actuator being configured to drive the shovel, the space recognition device being configured to recognize a situation in surroundings of the shovel, the operating device being configured to receive an operation of the actuator.

10. A shovel comprising:

a lower traveling structure;

an upper swing structure swingably mounted on the lower traveling structure;

an attachment attached to the upper swing structure; and the controller as set forth in claim 1.

11. A method of managing a worksite executed by processing circuitry, comprising:

predicting a motion of a shovel; and in response to predicting, based on a work pattern being executed by the shovel, that the shovel next performs a predetermined motion, issuing an alert indicating that the predetermined motion is to be performed to an area surrounding the shovel before a start of the predetermined motion, the work pattern representing a flow of a plurality of motions of the shovel that constitute a single piece of work performed by the shovel and are carried out in order, the work pattern being divided into a plurality of motion sections corresponding to the plurality of motions, wherein each of the plurality of motion sections is defined by a start and an end, and a start determining condition for determining the start of each of the plurality of motion sections and an end determining condition for determining the end of each of the plurality of motion sections are recorded in association with the work pattern.

12. The method as claimed in claim 11, wherein said predicting predicts the motion of the shovel by monitoring a movement of an operator of the shovel.

13. The controller as claimed in claim 1, wherein the processing circuitry is further configured to analyze history information of work patterns collected from a sensor included in the shovel and predict a motion to be next performed by the shovel based on the work pattern being executed by the shovel.

14. A controller for a shovel, comprising:

processing circuitry configured to determine a work pattern corresponding to a current motion of the shovel, the current motion of the shovel satisfying a predetermined condition for determining a start of the work pattern, the work pattern representing a flow of a plurality of motions of the shovel that constitute a single piece of work performed by the shovel and are carried out in order, the work pattern being divided into a plurality of motion sections corresponding to the plurality of motions, the work pattern being stored in association with the predetermined condition;

predict a motion to be predicted of the shovel, the motion to be predicted being predetermined for the work pattern; and in response to predicting, based on the determined work pattern, that the shovel next performs the predetermined motion, issue an alert indicating that the predetermined motion is to be performed to an area surrounding the shovel before a start of the predetermined motion, wherein each of the plurality of motion sections is defined by a start and an end, and a start determining condition for determining the start of each of the plurality of motion sections and an end determining condition for determining the end of each of the plurality of motion sections are recorded in association with the work pattern.

15. The controller as claimed in claim 14, wherein the processing circuitry is further configured to determine whether the end determining condition for determining the end of a first motion section immediately before a second motion section in which the shovel performs the predetermined motion among the plurality of motion sections of the determined work pattern is satisfied; and predict that the shovel next performs the predetermined motion in response to determining that the condition for determining the end of the first motion section is satisfied.

16. The controller as claimed in claim 14, wherein the processing circuitry is further configured to learn a plurality of work patterns by analyzing information on past work details of the shovel obtained with a sensor of the shovel, or based on a movement pattern of an operator of the shovel imaged by a camera;

store the learned work patterns in a database; and determine the work pattern by selecting the work pattern from the database.

17. The controller as claimed in claim 16, wherein the processing circuitry is further configured to learn the plurality of work patterns in view of a surrounding situation of the shovel.

18. A shovel comprising:

a lower traveling structure;

an upper swing structure swingably mounted on the lower traveling structure;

an attachment attached to the upper swing structure; and the controller as set forth in claim 14.

19. The controller as claimed in claim 1, wherein the processing circuitry is further configured to identify a motion section corresponding to a current state of working of the shovel and determine whether the identified motion section corresponds to a motion section immediately before a motion section in which the shovel performs the predetermined motion, by determining whether the start determining condition is satisfied with respect to each of the plurality of motion sections, determine whether the end determining condition for determining the end of the identified motion section is satisfied in response to determining that the identified motion section corresponds to the motion section immediately before the motion section in which the shovel performs the predetermined motion, and predict that the shovel next performs the predetermined motion and issue the alert, in response to determining that the end determining condition for determining the end of the identified motion section is satisfied.

20. The controller as claimed in claim 1, wherein the single piece of work is crane work or slope forming work.

* * * * *